US007257853B2

(12) United States Patent
Boyer et al.

(10) Patent No.: US 7,257,853 B2
(45) Date of Patent: Aug. 21, 2007

(54) MOPS AND MOP COMPONENTS

(75) Inventors: Chris Boyer, Oak Park, IL (US); Miroslav Vuckovic, Skokie, IL (US)

(73) Assignee: Freudenberg Household Products LP, Northlake, IL (US)

( * ) Notice: Subject to any disclaimer, the term of this patent is extended or adjusted under 35 U.S.C. 154(b) by 625 days.

(21) Appl. No.: 10/634,306

(22) Filed: Aug. 5, 2003

(65) Prior Publication Data

US 2005/0028309 A1 Feb. 10, 2005

(51) Int. Cl.
*A47L 13/146* (2006.01)

(52) U.S. Cl. ..... 15/119.2; 15/118; 15/244.1

(58) Field of Classification Search ..... 15/116.2, 15/119.2, 118, 244.1
See application file for complete search history.

(56) References Cited

U.S. PATENT DOCUMENTS

| | | | | |
|---|---|---|---|---|
| 2,699,563 | A | 1/1955 | Duncan | |
| 2,730,744 | A | 1/1956 | Vaughn | |
| 2,733,467 | A | 2/1956 | Garro | |
| 2,779,959 | A | 2/1957 | Hvale | |
| 2,852,794 | A | 9/1958 | Blum | |
| 2,892,201 | A | 6/1959 | Peterson et al. | |
| 2,959,799 | A | 11/1960 | Greenleaf et al. | |
| 4,216,562 | A * | 8/1980 | Strahs | 15/119.2 |
| 4,864,675 | A * | 9/1989 | Jones | 15/119.2 |
| 5,042,105 | A | 8/1991 | Buck et al. | |
| 5,131,111 | A | 7/1992 | Richardson et al. | |
| 5,272,783 | A | 12/1993 | Richardson et al. | |
| 5,406,667 | A * | 4/1995 | Teufel et al. | 15/119.2 |
| 5,522,110 | A | 6/1996 | Borofsky | |
| 5,887,309 | A | 3/1999 | Lin | |
| 5,979,004 | A | 11/1999 | Wilson | |
| 6,000,087 | A | 12/1999 | Petner | |

(Continued)

FOREIGN PATENT DOCUMENTS

| | | |
|---|---|---|
| CA | 767342 | 9/1967 |

(Continued)

*Primary Examiner*—Mark Spisich
(74) *Attorney, Agent, or Firm*—Leydig, Voit & Mayer, Ltd.

(57) ABSTRACT

Disclosed is a butterfly mop having an elongate shaft with a mop element disposed at one end of the shaft and a wringer connected to the shaft and the mop element. In preferred embodiments, the wringer includes a channel body having first and second leg portions defining a channel therebetween. The mop element includes a foldable, compressible, liquid-absorbent member, a mounting element having first and second support portions connected by a flexible member, and a scrubber mounted to the mounting element. The mop element and channel body are movable relative to one another, whereby the mop element may be drawn into the channel causing the mop element to fold along a central transverse axis and to become compressed between the channel body leg portions. The wringer includes a handle and an actuator link connecting the handle to one of the mop element and channel body for effecting relative hinged movement thereof. In some embodiments, the mop element includes a support that has first and second support portions and a flexible member connecting the first and second support portions. In certain embodiments, a fastener having a barbed shaft is used to connect the mop element to the wringing mechanism of the mop.

40 Claims, 28 Drawing Sheets

U.S. PATENT DOCUMENTS

| | | | | |
|---|---|---|---|---|
| 6,058,548 | A * | 5/2000 | Footer et al. | 15/119.2 |
| 6,217,244 | B1 | 4/2001 | Chen et al. | |
| 6,785,928 | B2 | 9/2004 | Specht et al. | |
| 6,854,149 | B1 | 2/2005 | Specht et al. | |
| 2006/0137121 | A1* | 6/2006 | Niccolai | 15/119.2 |

FOREIGN PATENT DOCUMENTS

| | | |
|---|---|---|
| GB | 932579 | 7/1963 |
| GB | 2 258 142 | 2/1993 |
| WO | WO99/09876 | 3/1999 |

* cited by examiner

MOPS AND MOP COMPONENTS

TECHNICAL FIELD OF THE INVENTION

The present invention is directed toward mops, and more specifically, is in the field of butterfly mops.

BACKGROUND OF THE INVENTION

Butterfly mops are characterized in that they comprise an elongate, foldable, compressible, liquid-absorbent member, such as a sponge, which is disposed at one end of a mop shaft, and which is used to absorb liquid, typically water, from a surface. When it is desired to expel liquid from the absorbent member, portions of the absorbent member are folded over one another along a transverse axis of the absorbent member and are compressed, using a folding mechanism such as a roller or track. Butterfly mops are so named because the folding and unfolding of the absorbent member along its transverse axis is said to resemble the motion of the wings of a butterfly.

One typical butterfly mop is shown in U.S. Pat. No. 2,892,201. As shown therein, the butterfly mop includes a liquid absorbent member, two plates connected to a surface of the liquid absorbent member, and an activating rod pivotally connected to each of the two plates. The plates are drawn along the dual arms of a yoke-like track to thereby fold the liquid absorbent member over onto itself and to compress the liquid absorbent member within a compression space disposed between and defined by the dual arms of the track. Numerous other butterfly mops are known in the prior art.

A problem with conventional butterfly mops is the difficulty inherent in manually applying sufficient force to the actuating mechanism to fold the liquid absorbent member over onto itself and to compress the liquid absorbent member sufficiently to satisfactorily expel liquid therefrom. Indeed, in typical butterfly mops, substantial physical effort may be required to compress the absorbent member. Another drawback lies in the difficulty of removing a spent liquid absorbent member and of attaching a new member.

One excellent butterfly mop is disclosed in U.S. patent application Ser. No. 09/514,711, filed on Feb. 28, 2000. The invention seeks to provide a mop and mop components that improve upon prior art mops. In some respects, the invention seeks to improve upon the mop disclosed in U.S. patent application Ser. No. 09/514,711.

THE INVENTION

Generally, the invention provides a mop that includes an elongate shaft, a mop element disposed at a cleaning end of the shaft and a wringing mechanism. The wringing mechanism is connected to the shaft and to the mop element and is operable to compress the mop element for expelling liquid absorbed therein. The mop element can be secured to the wringing mechanism by a plurality of fasteners. The mop element has a longitudinal axis and a central transverse axis which is generally perpendicular to the longitudinal axis thereof. Operation of the wringer causes the mop element to fold about the central axis to compress the liquid absorbent member, thereby expelling liquid therefrom.

Numerous and varied embodiments of the invention are provided herein. The mop element can include a liquid absorbent member, a scrubber member which is relatively more abrasive than the liquid absorbent member, and a mounting element for supporting the liquid absorbing member and the scrubber member. The mounting element can include first and second support portions connected by one or more flexible members. Preferably, the mop mounting element is monolithic and includes two connecting members, each of which is flexible related to the first and second support portions.

Preferably, the wringing mechanism is configured somewhat comparably to that of the mop disclosed in prior U.S. patent application Ser. No. 09/514,711. In this respect, the wringing mechanism includes an operator handle, a channel body, and an actuator link. The operator handle is movably mounted to the shaft. The channel body is disposed at the cleaning end of the shaft and includes first and second legs which define a channel therebetween. The actuator link is connected to the operator handle and one of the mop element and the channel body. The channel body and mop element are disposed in a relatively hinged relationship with respect to one another along a hinge line lying along or parallel to the longitudinal axis of the mop element. The mop element and the channel body are relatively movable over a range of travel. Movement of the handle in a wringing direction effects relative hinged movement of the mop element and the channel body. The liquid absorbent member is drawn into the channel and is compressed therewithin to thereby expel water therefrom, the mop element folding along its transverse axis upon compression. The configuration of the mop element and the channel body provides torque which assists the operator in expelling liquid from the mop element.

In accordance with particularly preferred embodiments of the invention, the mop includes a mop element support having a first wing and a second wing. The liquid absorbent member of the mop element is mounted to the wings via the mounting element and fasteners. The first leg portion of the channel body includes a first roller rotatably mounted thereto and engaging the first wing, and the second leg portion includes a second roller rotatably mounted thereto and engaging the second wing. The rollers and wings serve to guide the liquid absorbent mop element into the channel. The wings can each include cam surfaces which guide the wings and which are believed to assist in compression of the mop element.

A fastener can be provided to retain the wings and mounting channel relative to one another. The fastener can include an operator gripping portion, a retaining portion, and an intermediate bearing portion disposed between the gripping portion and the retaining portion. The retaining portion can include a shaft having a plurality of barbs extending therefrom, which the barbs act to frictionally or otherwise engage the mounting channel.

The invention further contemplates a method of manufacturing a mop element and a mop. The method of manufacturing the mop element includes connecting the mounting element heretofore described to a liquid absorbent member. The method of manufacturing the mop includes connecting the mop element to a wringing mechanism and shaft assembly.

The features described above each may be included in a mop, or, in some embodiments, a mop may include one or some of the foregoing features. Other features of preferred embodiments of the invention are set forth hereinbelow.

BRIEF DESCRIPTION OF THE FIGURES

In these descriptions, the terms "top," "bottom," and the like should not be construed as limiting, because in practice the cleaning implement may be oriented omnidirectionally. Terms such as "enlarged" are provided to differentiate one figure from another but should not be construed as limiting the size of any product made in accordance with the invention.

DESCRIPTION OF THE PREFERRED EMBODIMENTS

Figure 1:
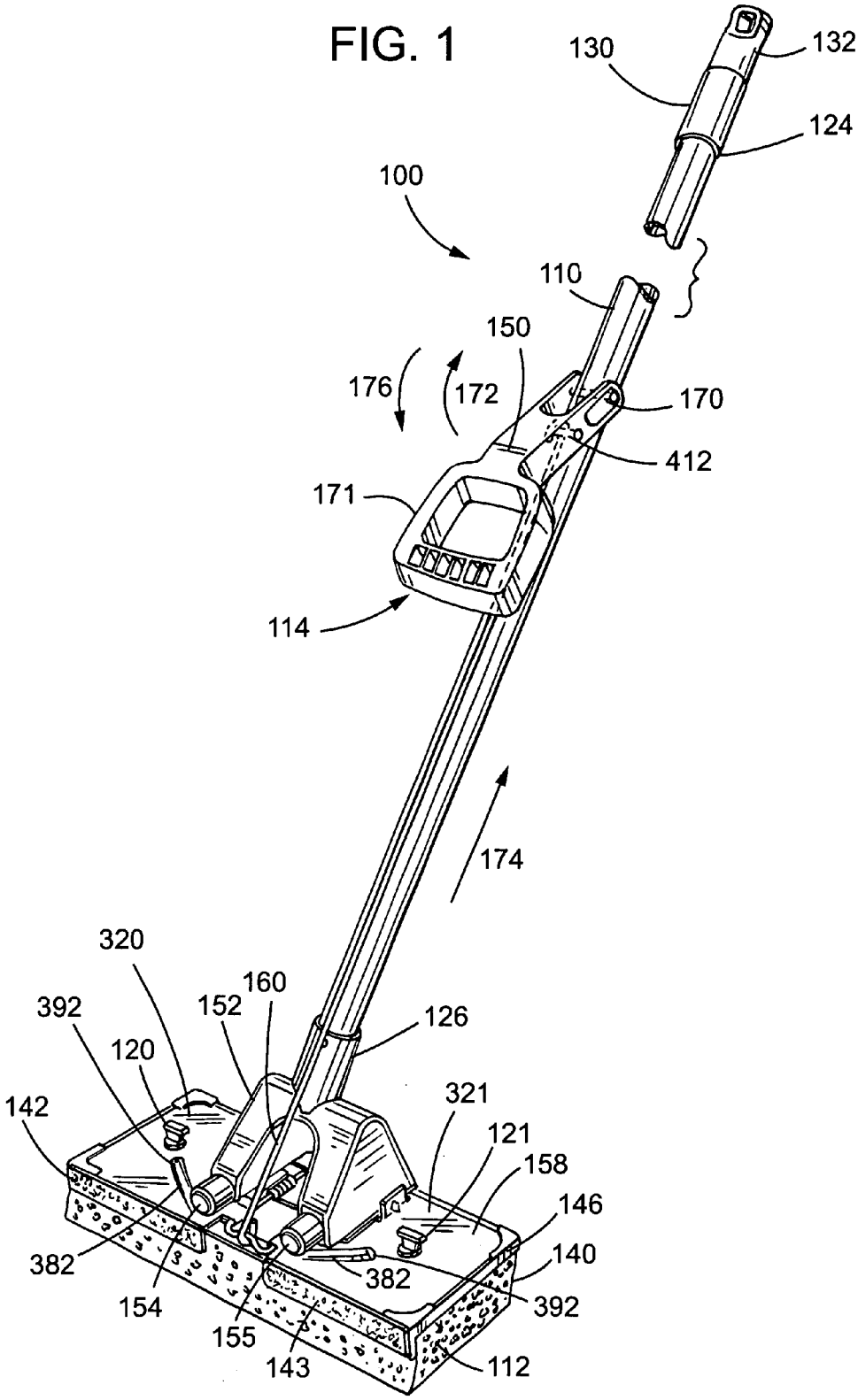
FIG. 1 is a perspective view of a mop according to the present invention.

Referring to FIG. 1, a butterfly mop 100 according to the present invention generally includes an elongate shaft 110, a mop element 112, and a wringing mechanism 114 that is connected to the shaft 110 and to the mop element 112. The shaft includes an operator end 124 and a cleaning end 126 which define a longitudinal axis. A hanging cap 130 is disposed at the operator end of the shaft 110. To facilitate mounting the mop, at least a portion 132 of the hanging cap can rotate with respect to the shaft about an axis that is collinear with the longitudinal axis of the shaft.

The mop element 112 is disposed at the cleaning end 126 of the shaft and is secured to a mop element support 158 of the wringing mechanism 114. The mop element 112 may comprise solely a compressible, elongate liquid absorbent member 140, but preferably comprises an assembly that further includes a pair of scrubber members 142, 143, and a mounting element 146 for supporting the liquid absorbent member and the scrubber members.

The wringing mechanism 114 is operable to compress the mop element 112 to expel liquid absorbed therein. The wringing mechanism 114 can include an operator handle 150 that is pivotally mounted to the shaft 110, a channel body 152 the is mounted to the cleaning end 126 of the shaft, a pair of rollers 154, 155 rotatably mounted to the channel body 152 and projecting therefrom, the mop element support 158 that is pivotally mounted to the channel body 152, and an actuator link 160 that is pivotally mounted to the operator handle 150 and to the mop element support 158. The mop element 112 is secured to the mop element support 158 via fasteners 120, 121.

The operator handle 150 is movably mounted to the shaft 110 via a pivotal mounting 170 for rotational movement of the operating handle with respect to the shaft about the pivot 170. The operator handle 150 includes an operator gripping portion 171 which can be moved with respect to the shaft 110 in an actuating direction 172 to move the actuator link 160 in a wringing direction 174, which in turn moves the mop element 112. The mop element 112 is movable over a range of travel from a cleaning position to a fully retracted wringing position. The operator handle 150 can be moved in a release direction 176 opposite to the actuating direction 172 to thus return the mop element to the cleaning position, shown in FIG. 1.

Figure 2:
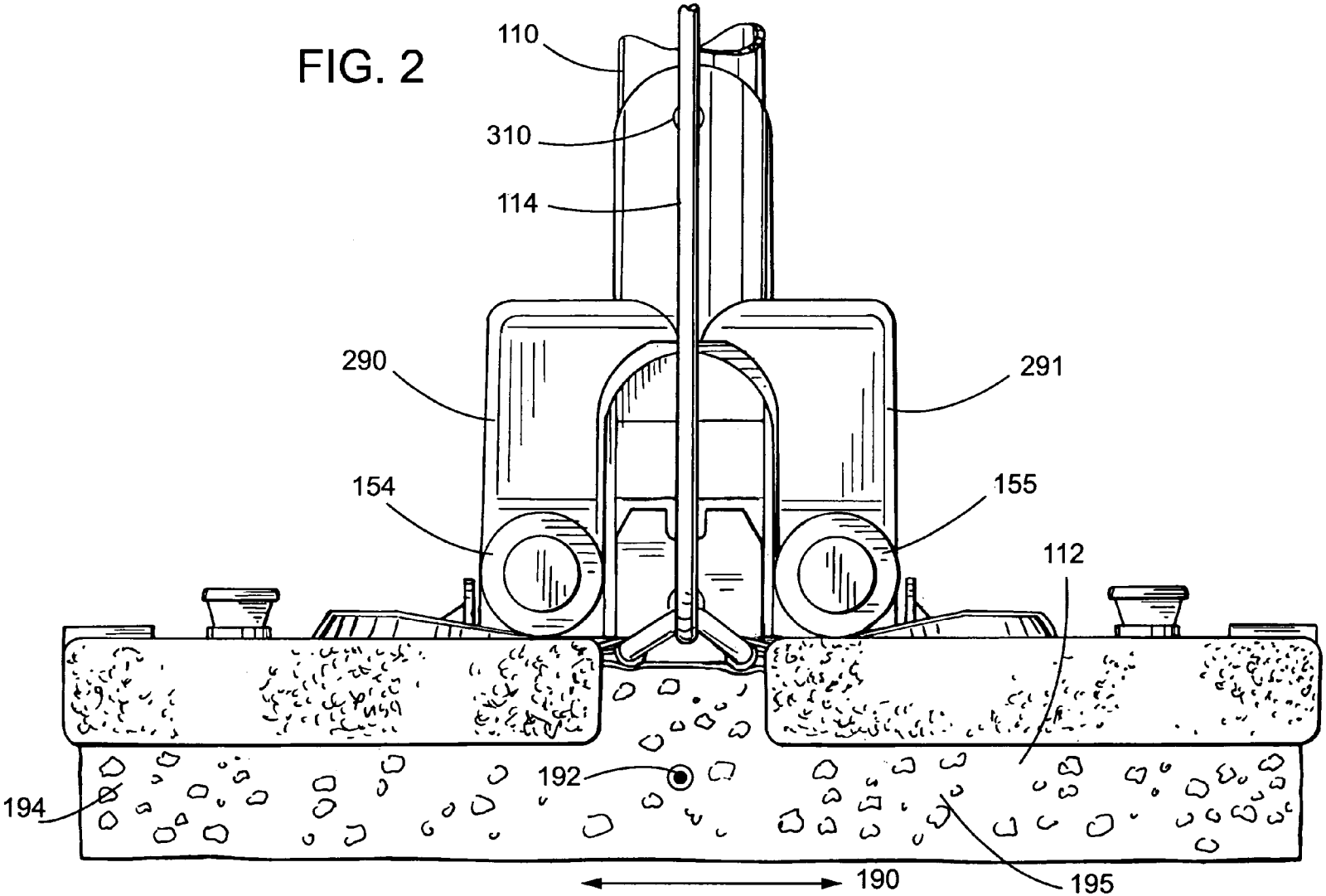
FIG. 2 is an enlarged, front elevational view of a cleaning end of a shaft of the mop of FIG. 1
Figure 3:
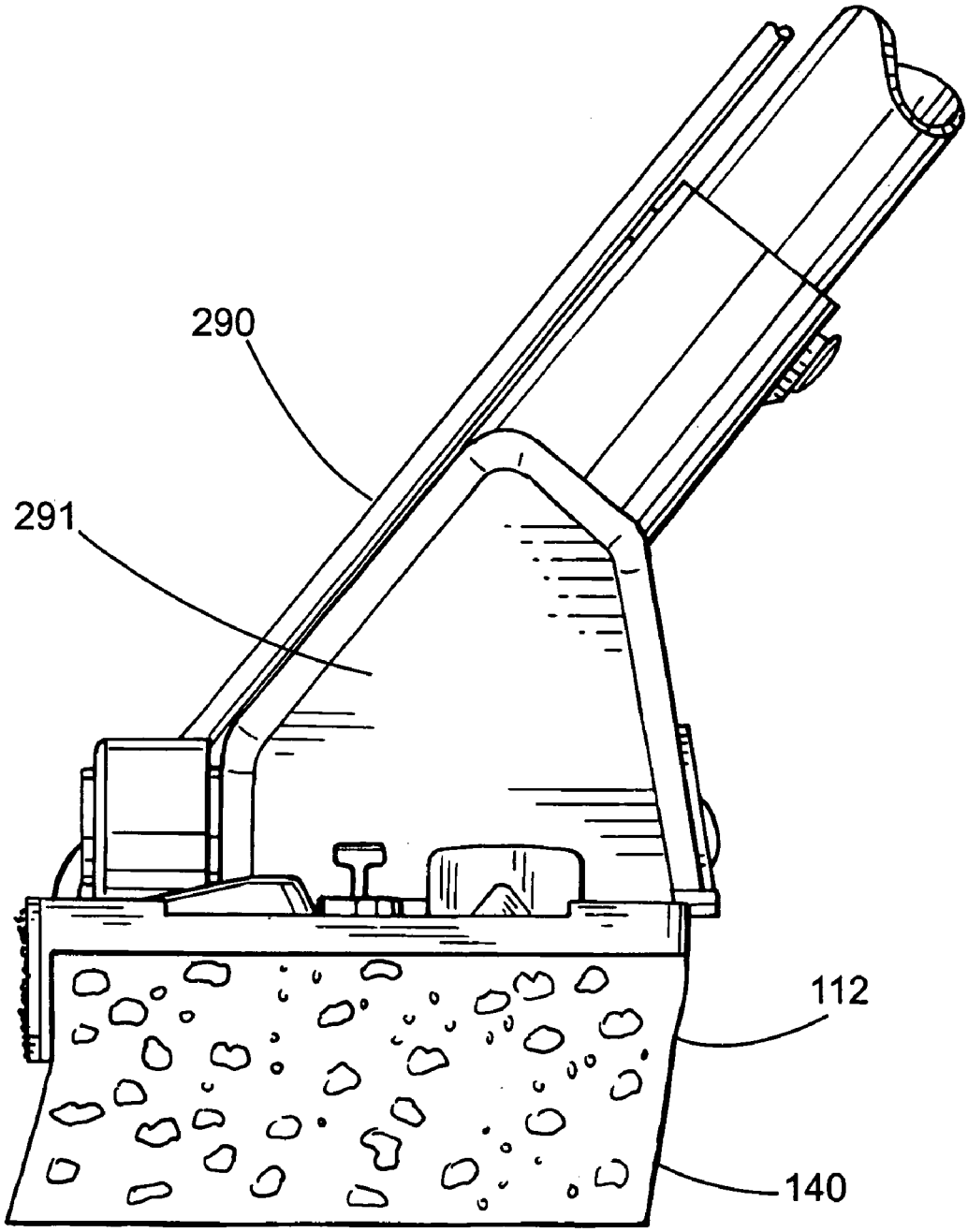
FIG. 3 is an enlarged, side elevational view of the cleaning end of the mop shown in FIG. 2.

Referring to FIG. 2, the mop element 112 has a longitudinal axis 190 and a central transverse axis 192, the central transverse axis 192 being generally perpendicular to the longitudinal axis 190. The central axis 192 lies in a central axial plane that divides the mop element into two regions, a first portion 194 and a second portion 195.

Figure 5:
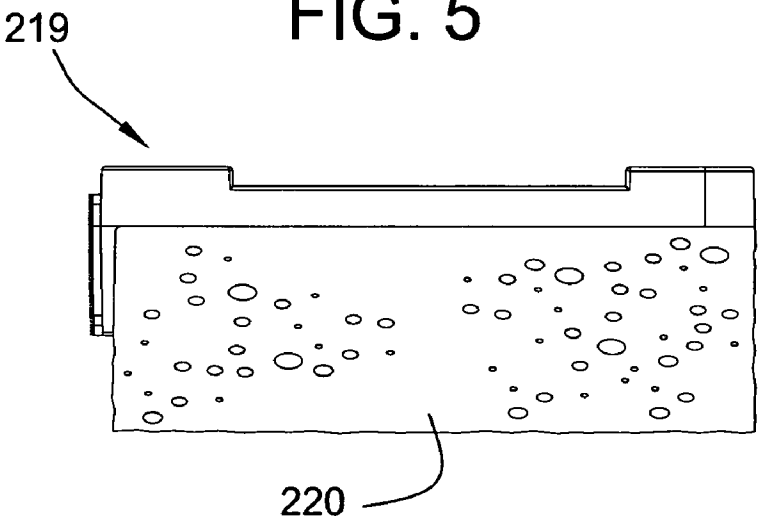
FIG. 5 is a side elevational view of another embodiment of a mop element assembly useful in connection with the mop of the present invention.
Figure 4:
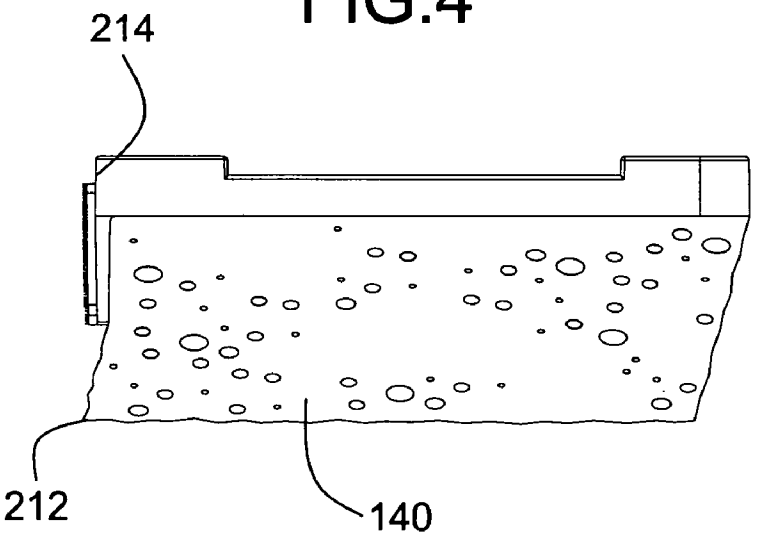
FIG. 4 is a side elevational view of the mop element assembly of the mop of FIG. 1.

The liquid absorbent member 140 is composed of a liquid absorbent material, which preferably is a synthetic sponge material. Referring to FIG. 4, the liquid absorbent member 140 includes a projecting leading edge 212 which can facilitate the cleaning of edges of surfaces and areas of surfaces disposed under obstructions by allowing the liquid absorbent member 140 to extend beyond a front edge 214 of the mounting element. The liquid absorbent member may be formed in the shape shown in FIG. 4, but preferably is formed with a generally parallelogram shaped cross-section. Alternatively, as shown in FIG. 5, the cross section of the liquid absorbent member 220 may be rectangular.

Figure 6:
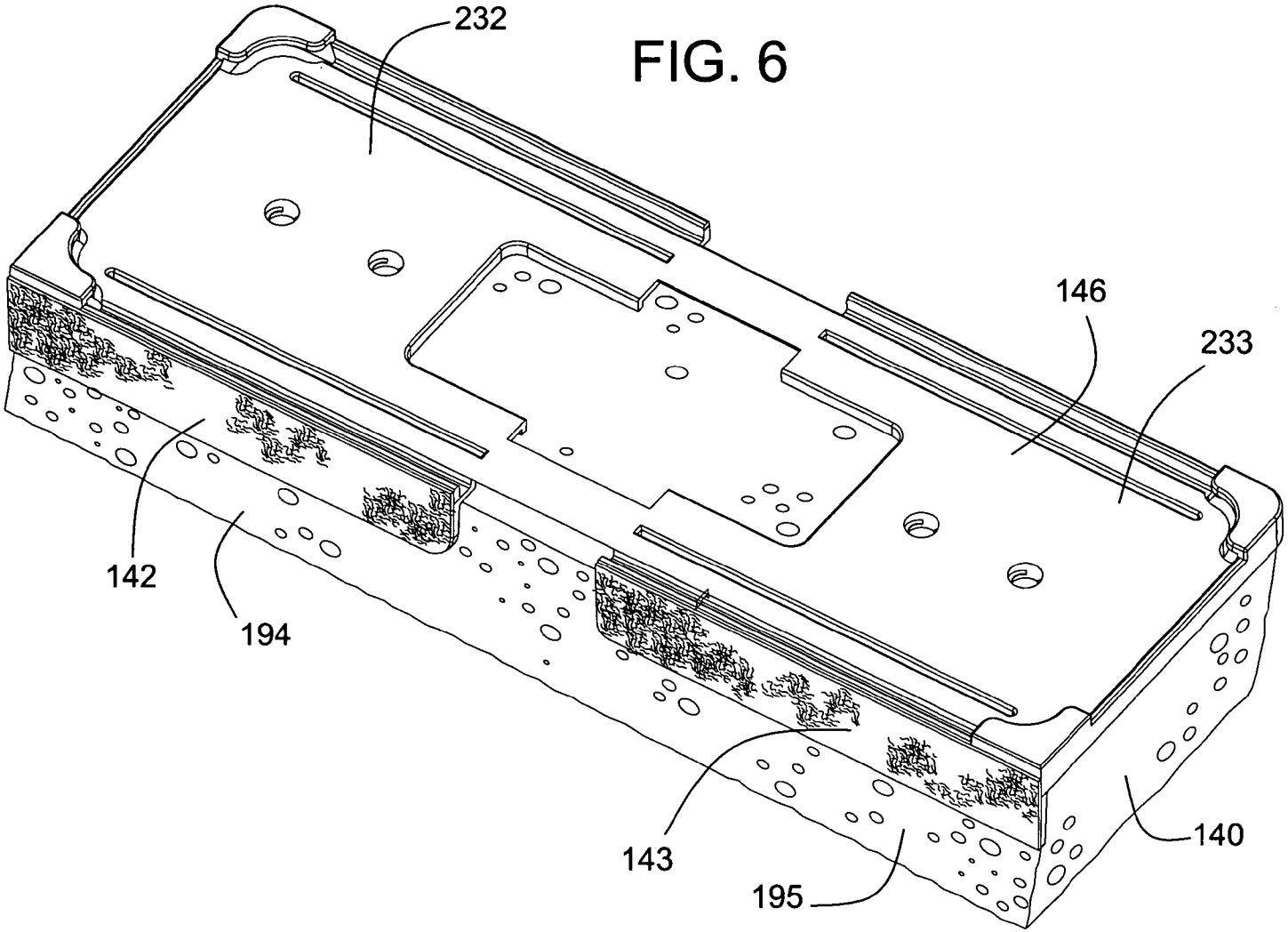
FIG. 6 is a perspective view of the mop element assembly of FIG. 4.
Figure 7:
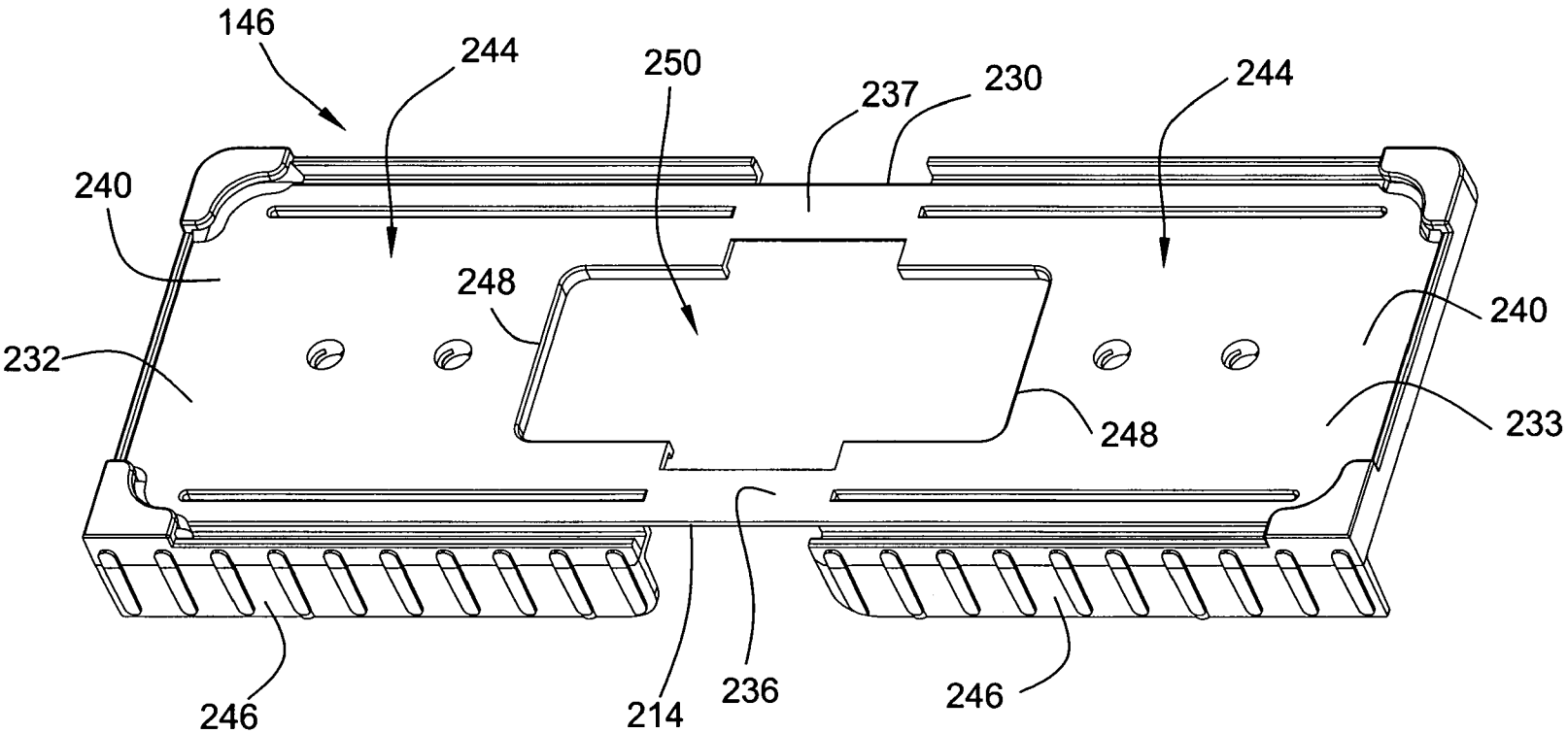
FIG. 7 is a perspective view of the mounting element of the mop element assembly of FIG. 4.

Referring to FIG. 6, a mounting element 146 is provided to support the liquid absorbent member 140 and the scrubber members 142, 143. The scrubber members can be removable or non-removable in ordinary use. Each scrubber member can be composed of a material that is abrasive relative to the liquid absorbent material. The scrubber members can be used in cleaning operations where the operator desires to clean a surface with an abrasive material.

Referring to FIGS. 7-14, the mounting element 146 includes first and second support portions 232, 233, which are connected together by a first flexible member 236 and a second flexible member 237. Preferably, the mounting element is of monolithic construction. The first and second support portions 232, 233 are rigid relative to the flexible portions 236, 237. Each of the first and second support portions 232, 233 can include a generally planar body portion 240, having a cleaning side 242 (FIGS. 10 and 12) and an opposing operator side 244, and a flange 246 extending generally perpendicularly from the front edge 214. Each support portion 232, 233 includes an inner recess 248 which align with one another to define an opening 250 which provides clearance for certain portions of the wringer (see FIG. 1). The first and second portions 194, 195 of the liquid absorbent member 140 are respectively mounted to the first and second support portions 232, 233 of the mounting element 146, as shown in FIG. 6. The flexible members may become separated from one or both of the first and second support portions 232, 233 during the mounting of the liquid absorbent member to the mounting element or after assembly, but the mop will still be operable.

Figure 12:
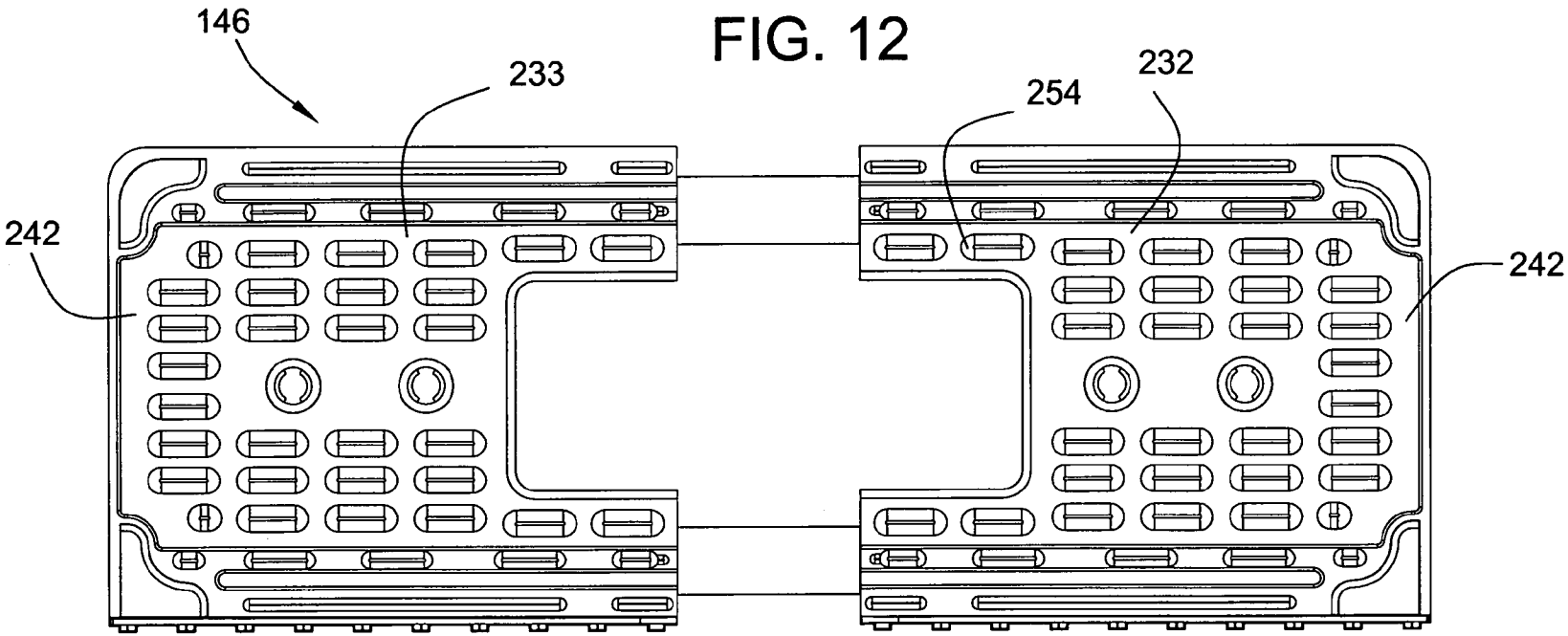
FIG. 12 is a bottom plan view of the mounting element of FIG. 7.

With specific reference to FIG. 12, the cleaning side 242 of the mounting element 146 can include a plurality of protrusions 254, which facilitate the mounting of the liquid absorbent member to the mounting element. Adhesive may be used to connect the liquid absorbent member to the mounting element, but, preferably, the liquid absorbent member is thermally fused to the mounting element 146 without the use of adhesive. The mounting element 146 can be heated to a predetermined temperature and/or for a predetermined amount of time at a predetermined temperature, for example. The liquid absorbent member can be pressed into the cleaning side 242 of the mounting element such that the protrusions 254, which have at least partially begun to melt from the heating, deform and interconnect with the liquid absorbent member. Upon the cooling of the mounting element, the liquid absorbent member is securely connected thereto. Alternatively, the liquid absorbent member can be connected to the mounting element in any other suitable fashion.

Figure 9:
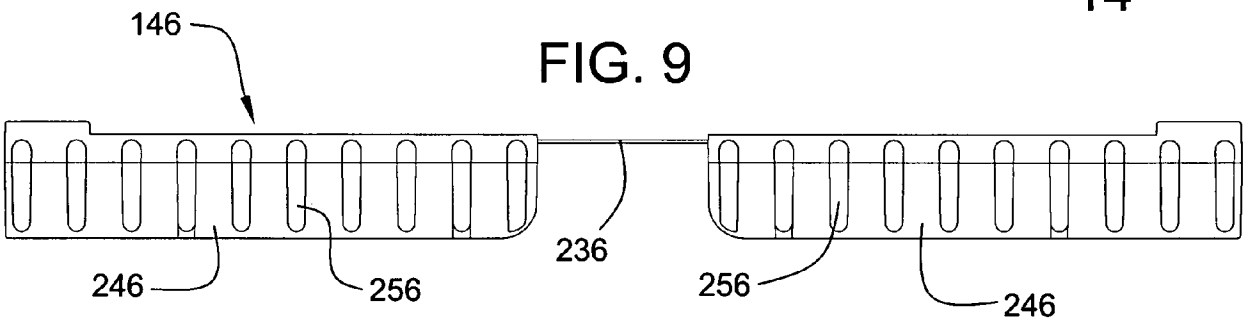
FIG. 9 is a front elevational view of the mounting element of FIG. 7.
Figure 10:
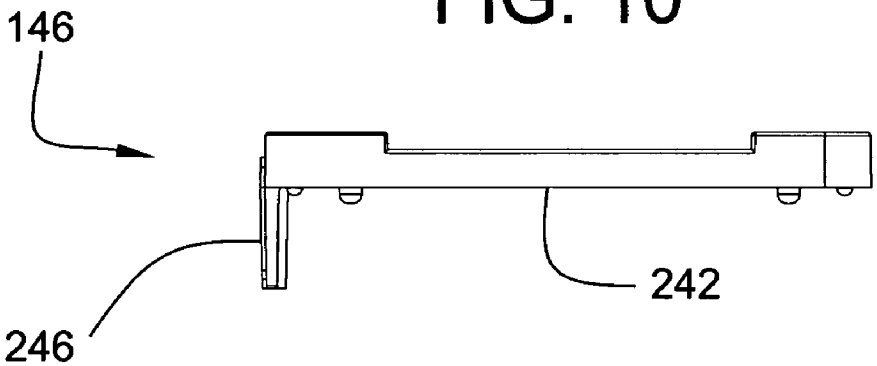
FIG. 10 is a side elevational view of the mounting element of FIG. 7.
Figure 11:
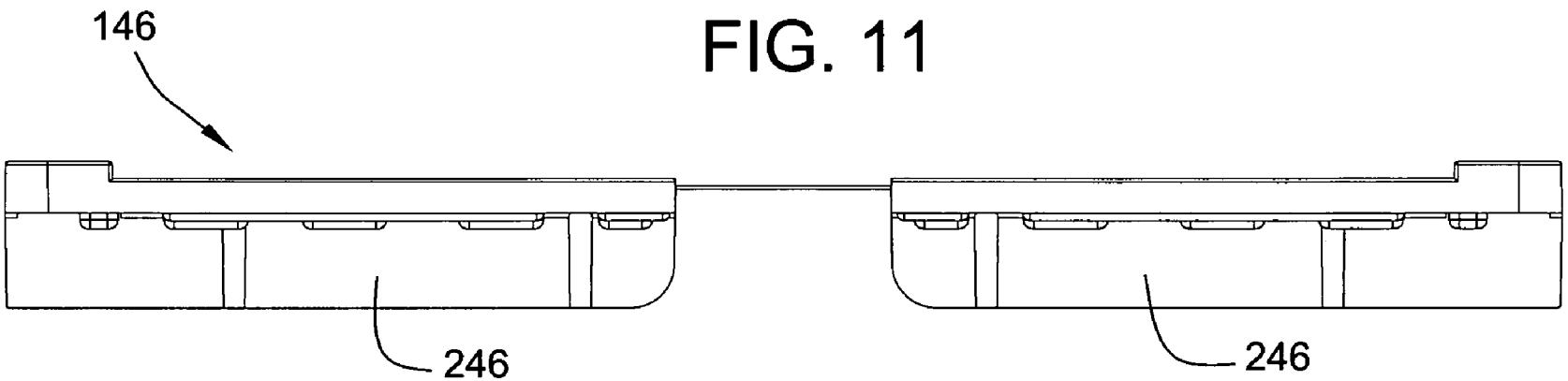
FIG. 11 is a rear elevational view of the mounting element of FIG. 7.

The flanges 246 can be used to secure the scrubber members to the mounting element. Referring to FIG. 9, each flange 246 can include a plurality of elongate ribs 256. The ribs 256 of the flanges 246 are useful in thermal fusing the scrubber strips thereto. In other embodiments, the scrubber strips can be removably secured to the flanges via other embodiments, such as adhesive, a hook-and-loop fastener arrangement, or a key-and-keyway arrangement.

Figure 8:
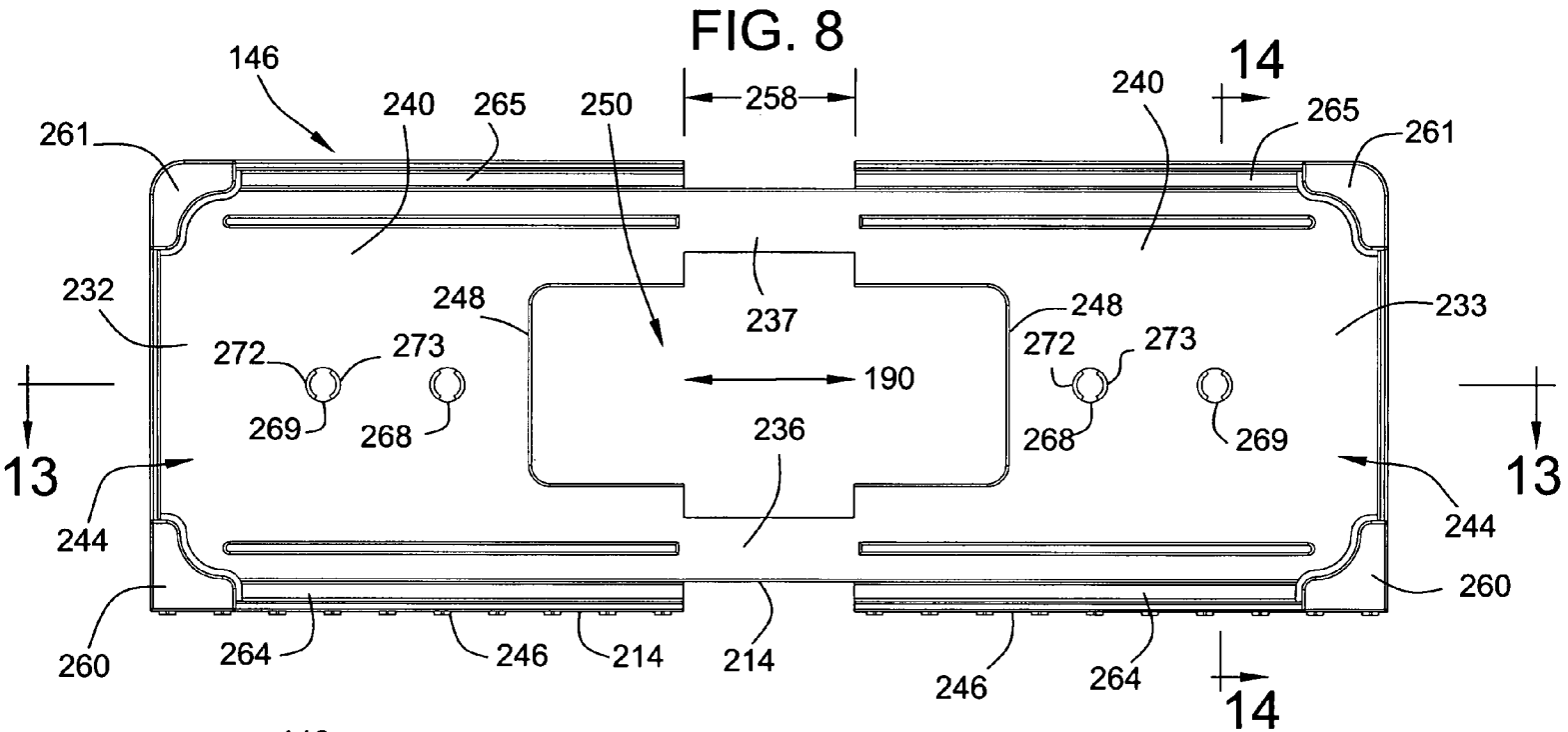
FIG. 8 is a plan view of the mounting element of FIG. 7.
Figure 13:
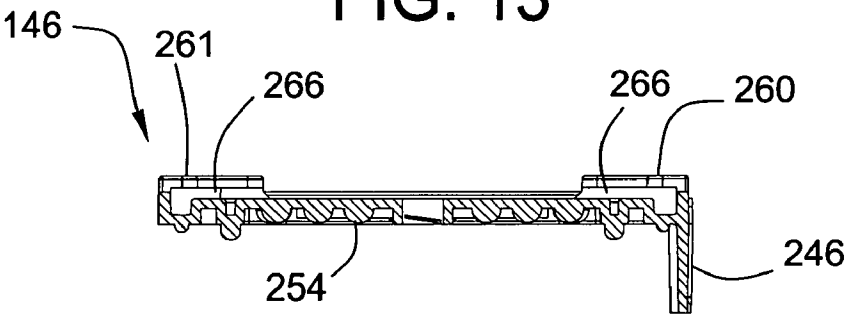
FIG. 13 is a cross-sectional view taken along line 13-13 in FIG. 12.
Figure 14:
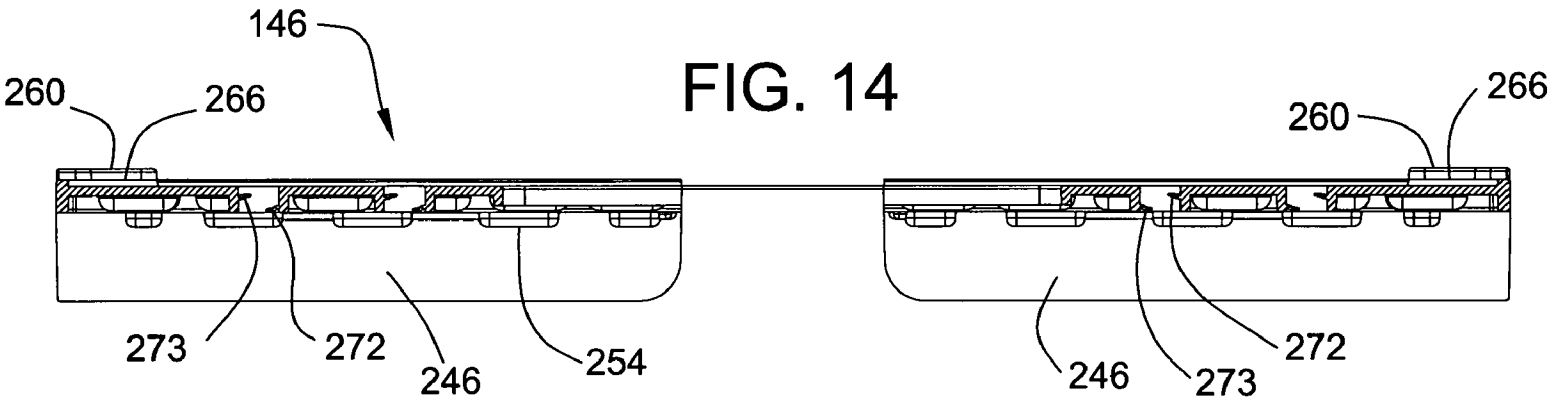
FIG. 14 is a cross-sectional view taken along line 14-14 in FIG. 12.

With further reference to FIG. 8, the first and second support portions 232, 233 can each include front and rear corner sleeves 260, 261 and front and rear mounting grooves 264, 265. The front and rear mounting grooves 264, 265 of the first and second support portions 232, 233 are respectively aligned with each other. The corner sleeves 260, 261 and the mounting grooves 264, 265 are provided to accommodate portions of the mop element support to facilitate the mounting of the mop element thereto and to substantially cover the perimeter of the mop element support. The front and rear corner sleeves 260, 261 of the support portions define respective slots 266, as shown in FIGS. 13 and 14, in which the corners of the mop element support may be retained. The corner sleeves 260, 261 can act as guards during a cleaning operation to help prevent the edges of the wings from gouging or otherwise damaging objects around the surface being cleaned, such as furniture or baseboard.

The mop element 112 can include at least one mounting aperture, and preferably includes a pair of mounting apertures with one aperture being disposed in the first portion and the other aperture being disposed in the second portion. The apertures of the mop element are positioned for alignment with respective mounting apertures in the mop element support.

Referring to FIG. 8, even more preferably, each support portion 232, 233 includes inner and outer mounting apertures 268, 269. Each of the mounting apertures 268, 269 can include first and second external threads 272, 273 extending therein. The threads 272, 273 can oppose each other and be offset from each other, as shown in FIG. 14, and can be provided to facilitate the retentive engagement of the fastener 120 shown in FIG. 27, as discussed hereinbelow. The four mounting apertures 268, 269 of the mounting element 146 are disposed to correspond to apertures in differently-sized mop element supports, thus permitting the mop element to be secured to mop element supports of various sizes.

Figure 15:
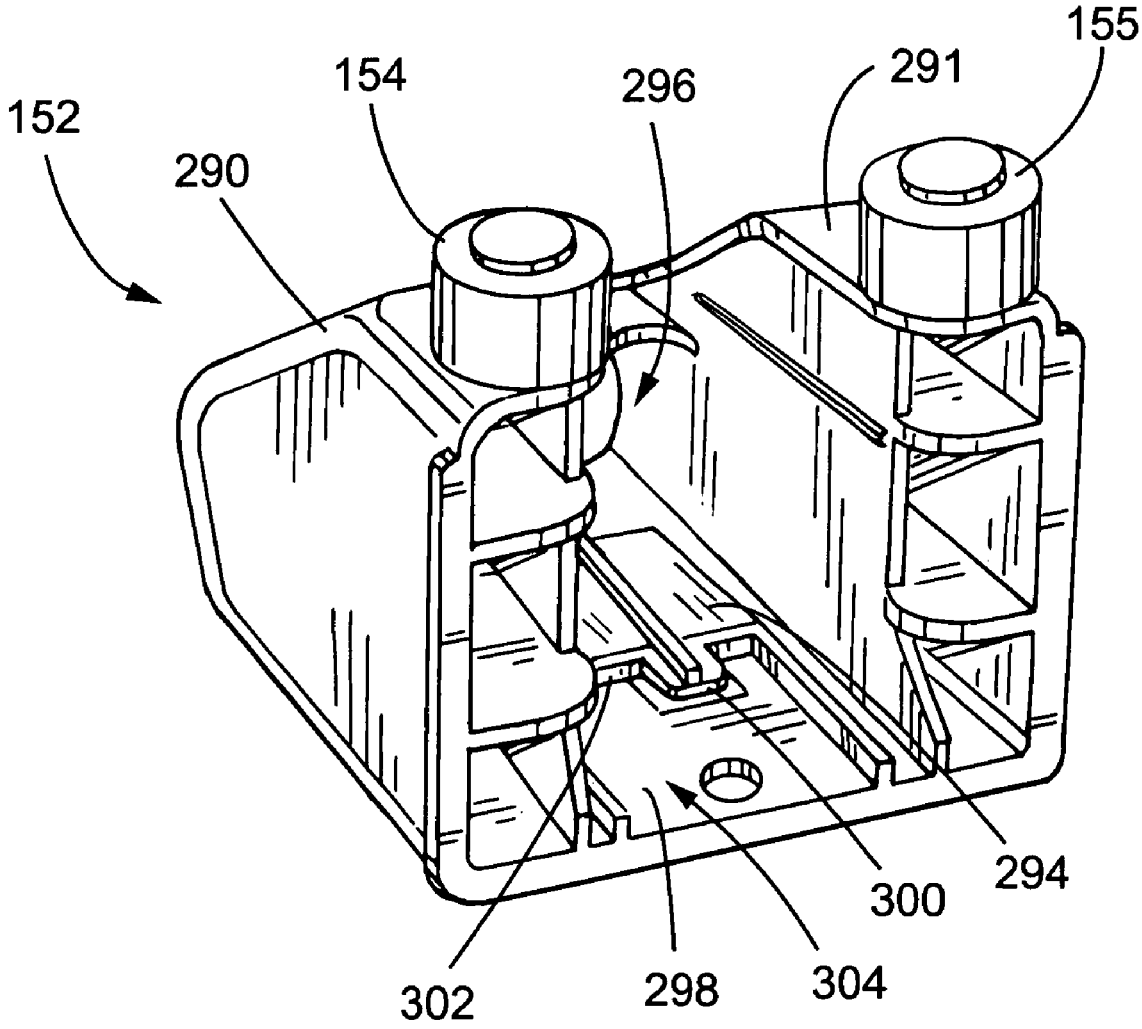
FIG. 15 is a perspective view of a channel body of the mop of FIG. 1.

Turning now to FIG. 15, the channel body 152 can be configured to engage the mop element during the wringing sequence such that the first and second portions of the mop element fold toward each other about the central axis to become compressed by the channel body. The channel body 152 includes a first leg portion 290 and a second leg portion 291 connected by an intermediate body portion 294. The first and second legs 291, 292 are in spaced relationship with each other such that they define a channel 296 therebetween. The channel body 152 can include a groove 298 for receiving the mop element support 158, as discussed in more detail hereinbelow. A tab 300 can extend from an end 302 of the groove 298 such that a portion of the mop element support is disposed between the tab 300 and a mounting surface 304 of the groove to help retain the mop element support thereto. The first and second rollers 154, 155 are rotatably mounted on the first and second leg portions 290, 291, respectively. The channel body 152 can be mounted to the shaft 110 by any suitable means, such as by a rivet 310, as shown in FIG. 2.

Figure 16:
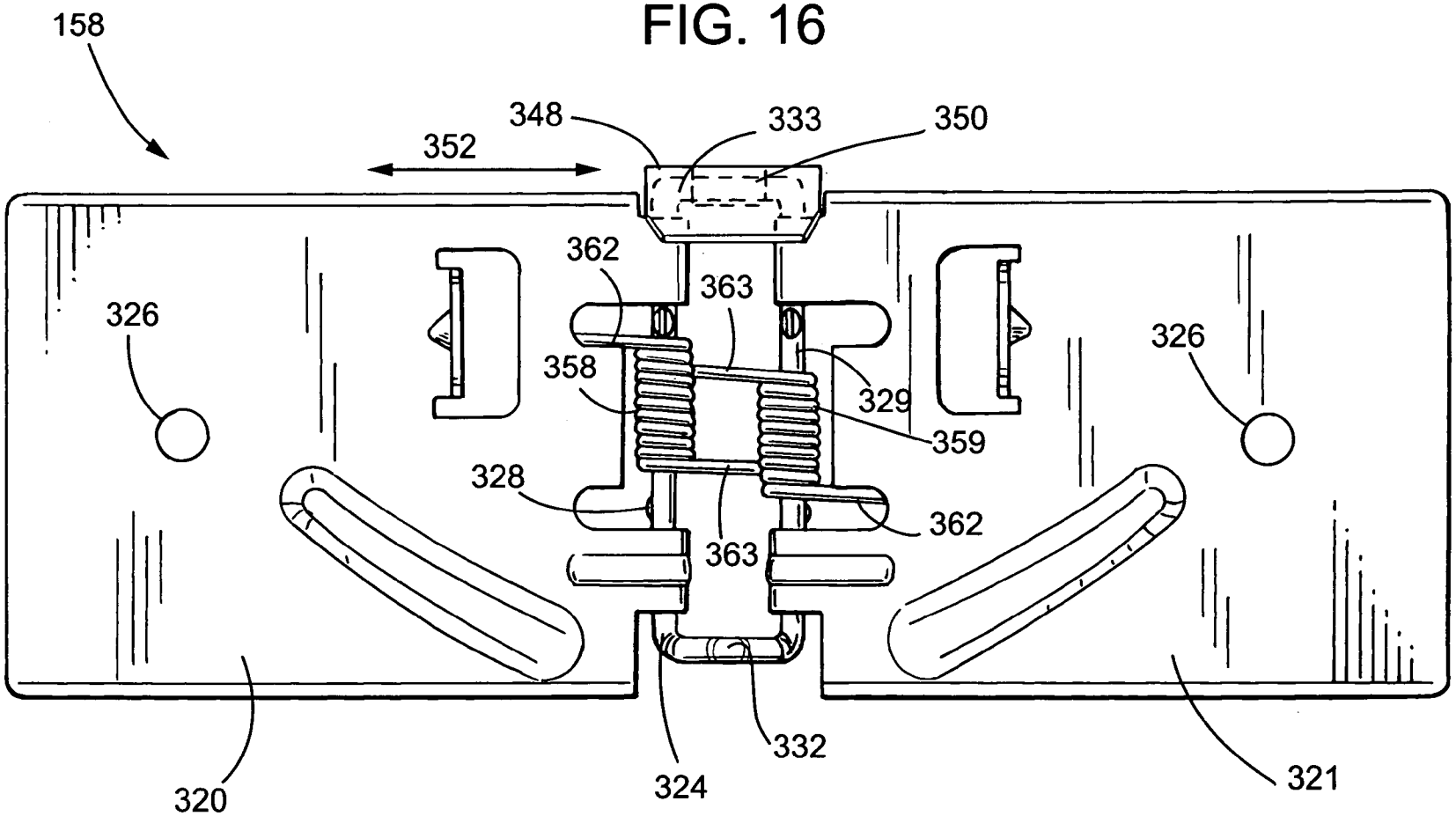
FIG. 16 is a plan view of the mop support element of the mop of FIG. 1.
Figure 17:
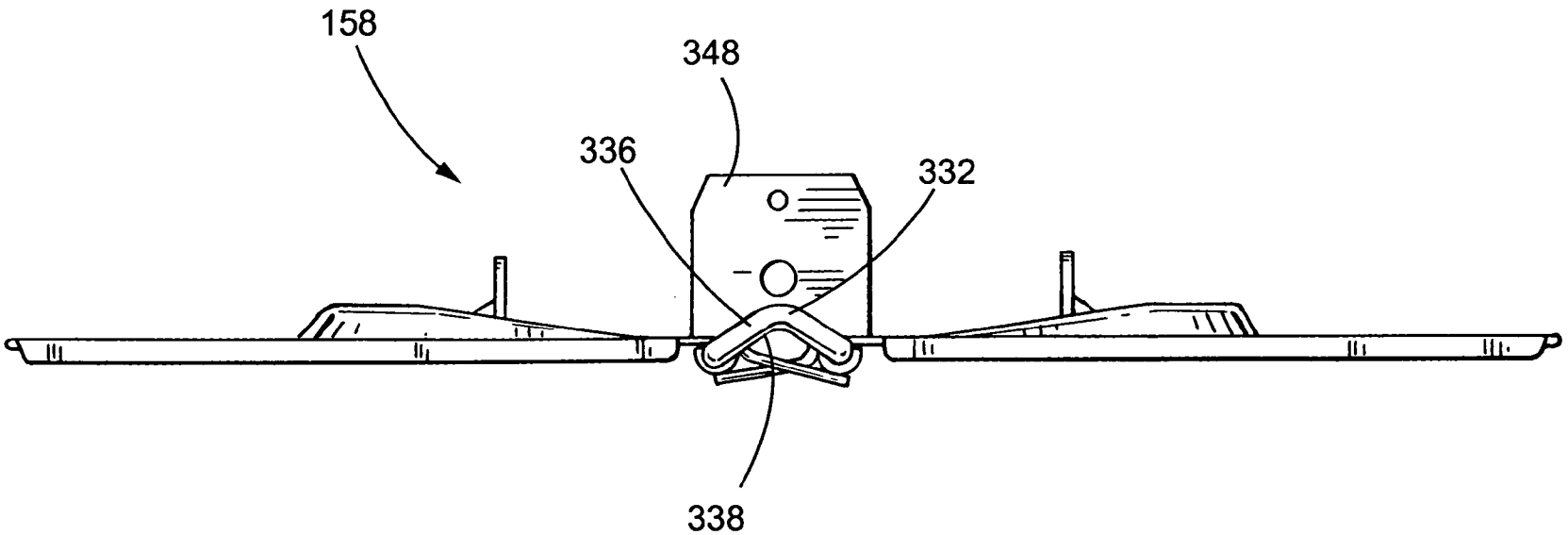
FIG. 17 is a front elevational view of the support element of FIG. 16.
Figure 18:
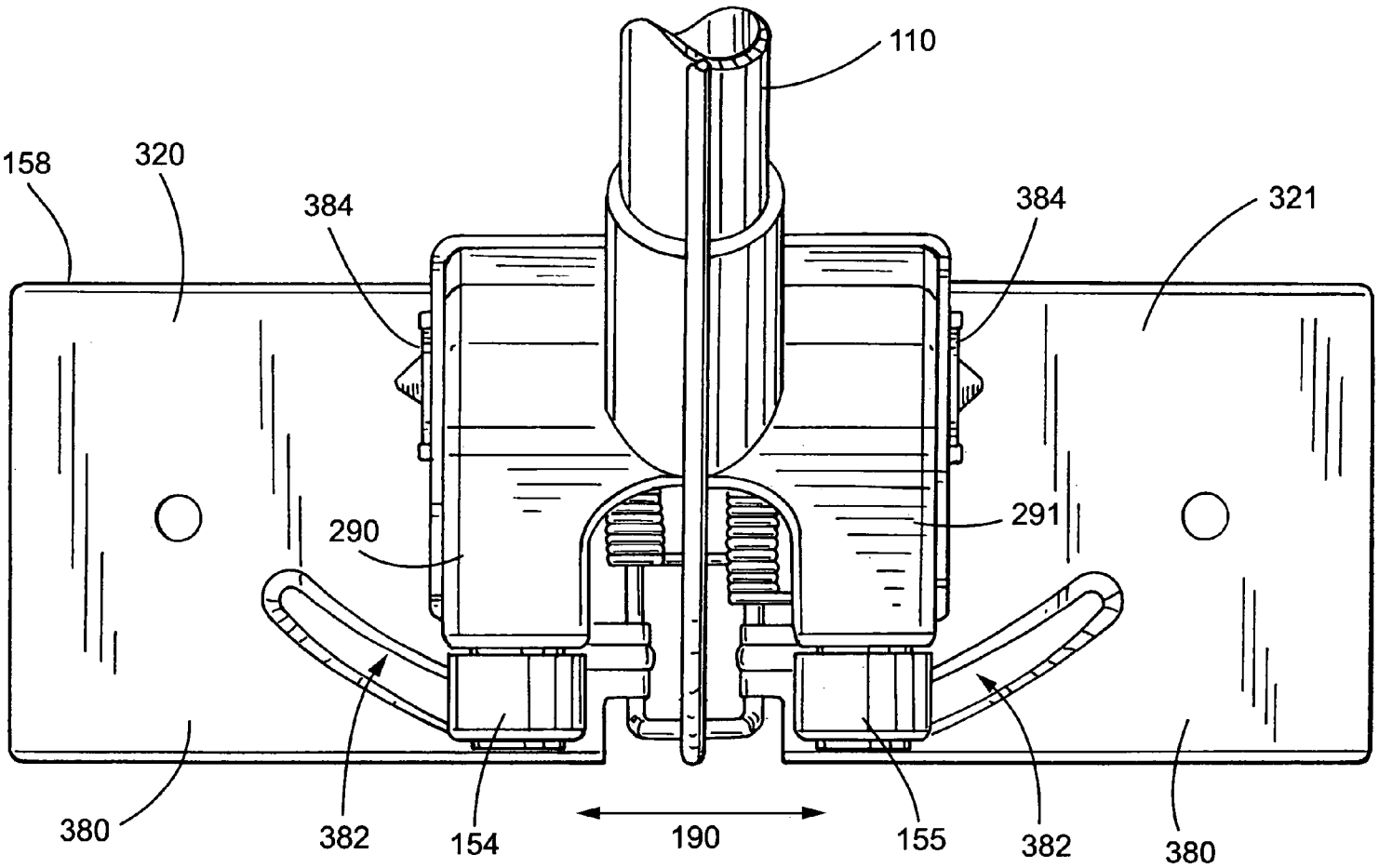
FIG. 18 is a plan view of the cleaning end of the mop of FIG. 1 with the mop element removed.

Referring to FIGS. 16 and 17, the mop element support 158 includes first and second wings 320, 321, which generally coincide with the first and second portions of the mop element, and a clasp 324 therebetween. The first and second wings 320, 321 are movable with respect to each other and, in the illustrated embodiment, each is hingedly mounted to the clasp 324. Each wing includes a mounting aperture 326 configured to align with one of the mounting apertures of the mop element. The clasp 324 includes a first arm 328 and a second arm 329 joined together by a first transverse member 332 and a second transverse member 333. The arms are in spaced relationship with each other as defined by the first and second transverse members. The first transverse member 332 can include a bent portion 336 which defines a notch 338 for receiving a distal end of the actuator link.

Figure 25:
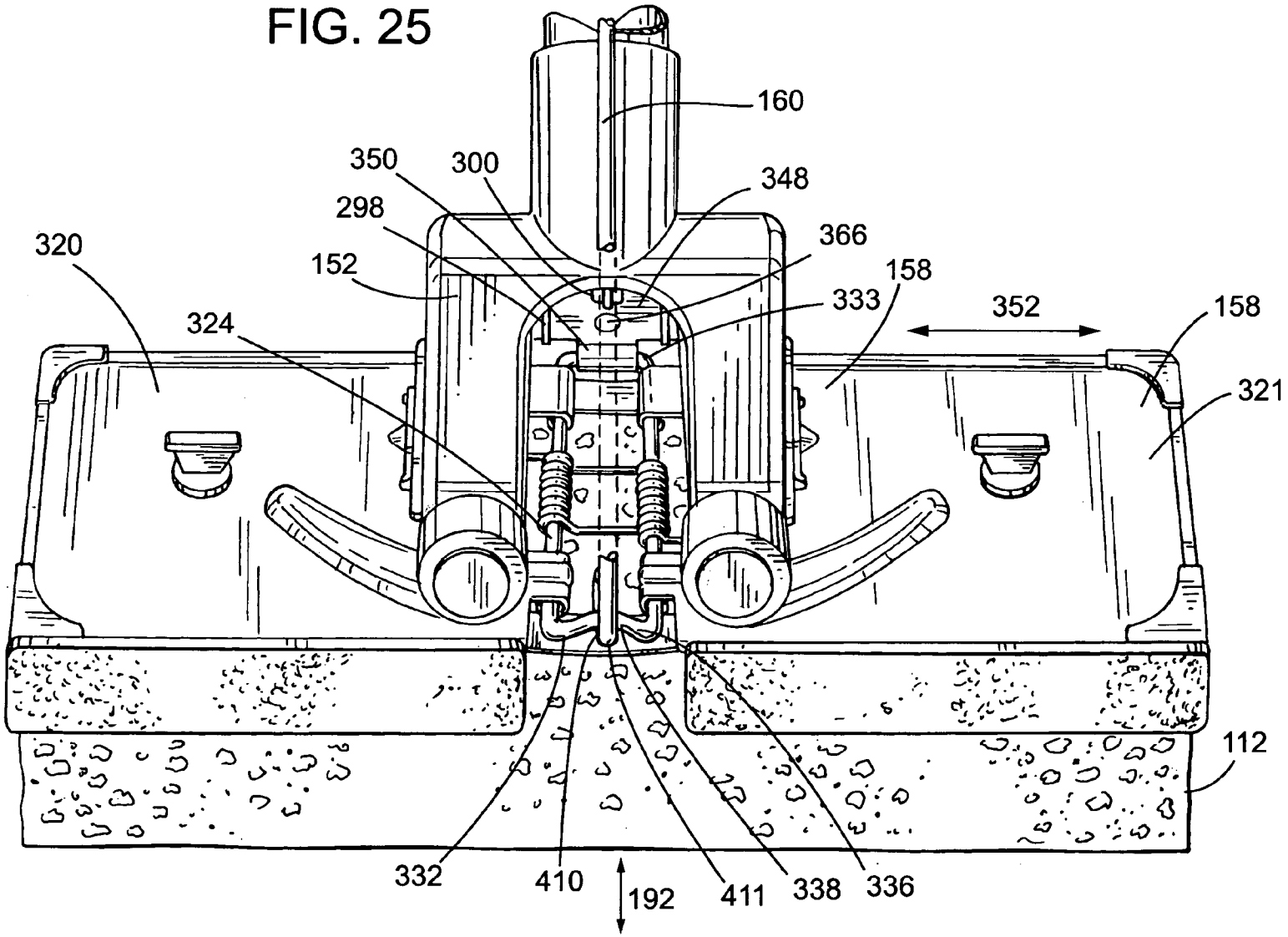
FIG. 25 is an enlarged, perspective view of the cleaning end of the mop shown in FIG. 2.

Referring to FIG. 25, the actuator link 160 can have an eyelet 410 at a distal end 411 thereof for retentive engagement with the clasp 324. The first transverse member 332 of the clasp can extend through the eyelet 410 at the distal end 411 of the actuator link, whereby the eyelet 410 is disposed in the notch 338.

Figure 20:
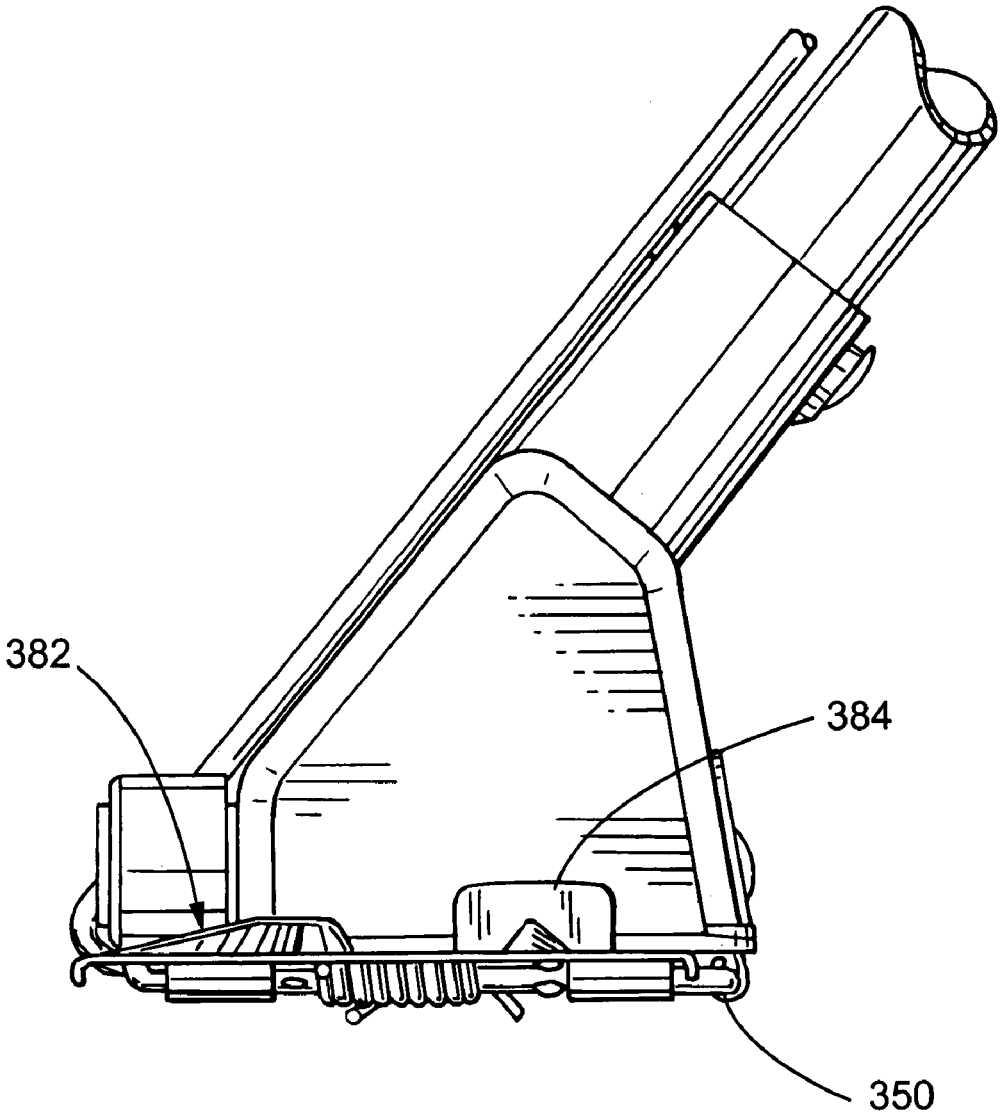
FIG. 20 is a side elevational view of the cleaning end of the mop as shown in FIG. 18.
Figure 21:
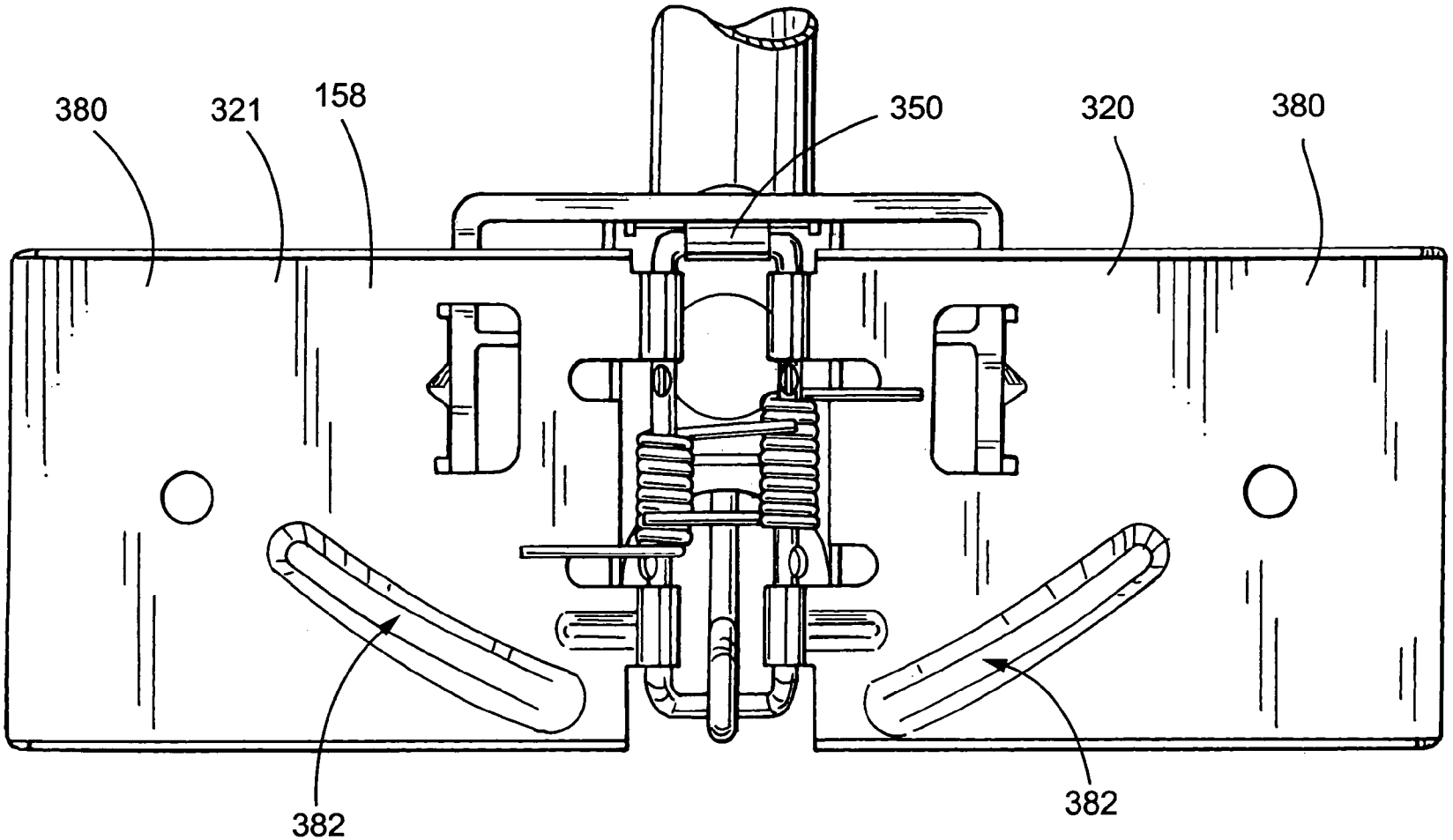
FIG. 21 is a bottom plan view of the cleaning end of the mop as in FIG. 18.
Figure 22:
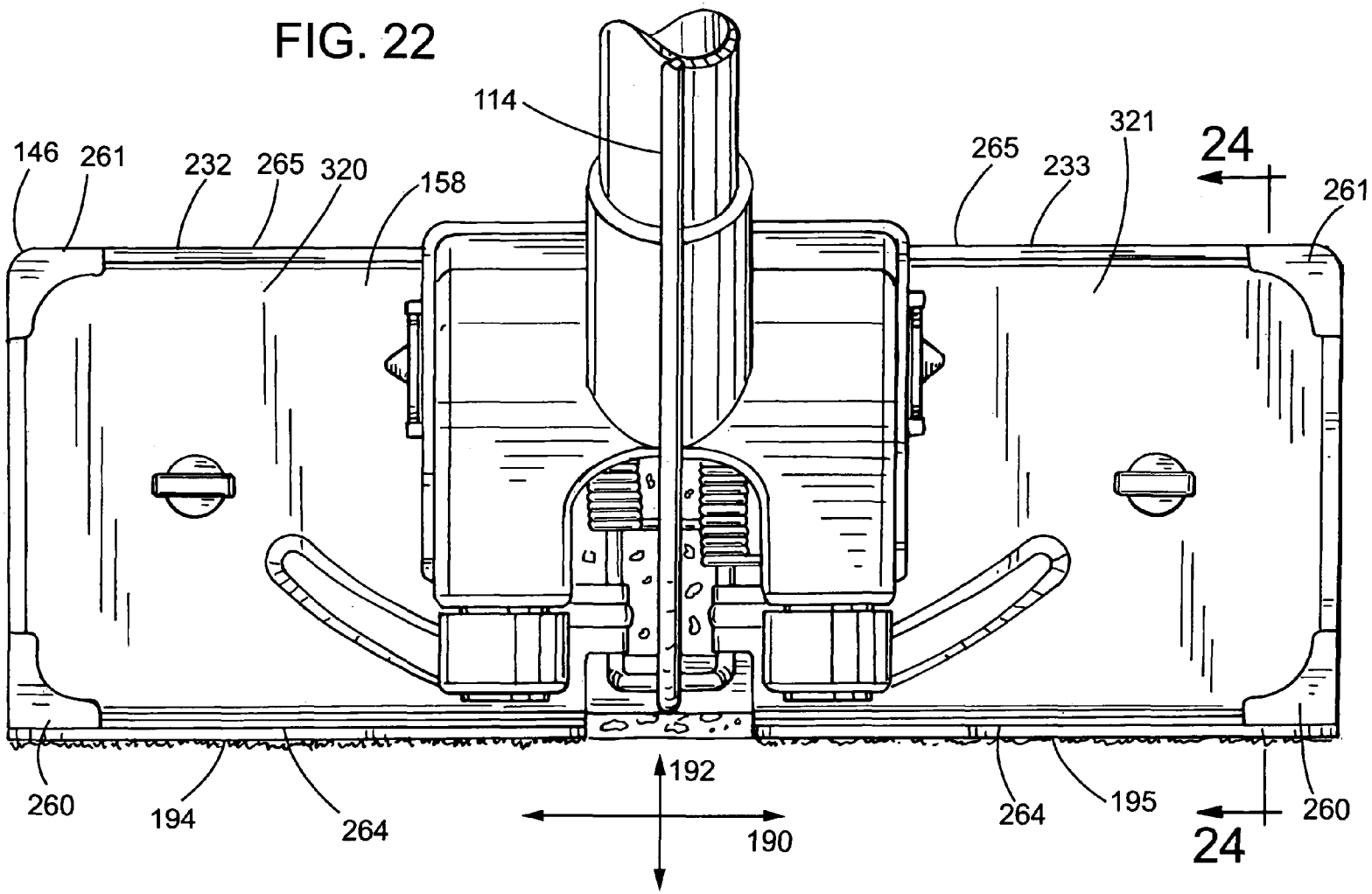
FIG. 22 is an enlarged, plan view of the cleaning end of the mop shown in FIG. 2.
Figure 23:
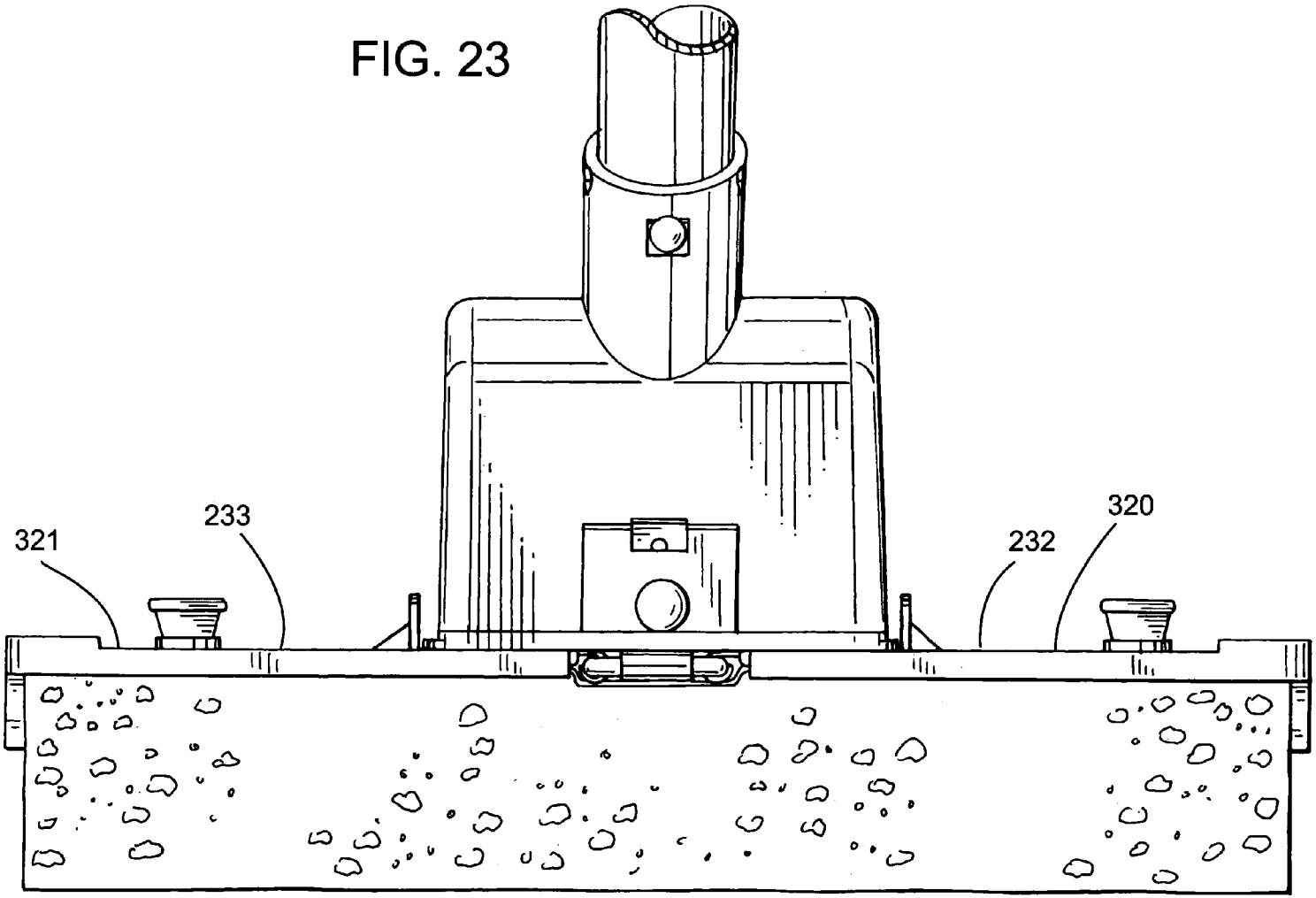
FIG. 23 is an enlarged, rear elevational view of the cleaning end of the mop shown in FIG. 2.
Figure 24:
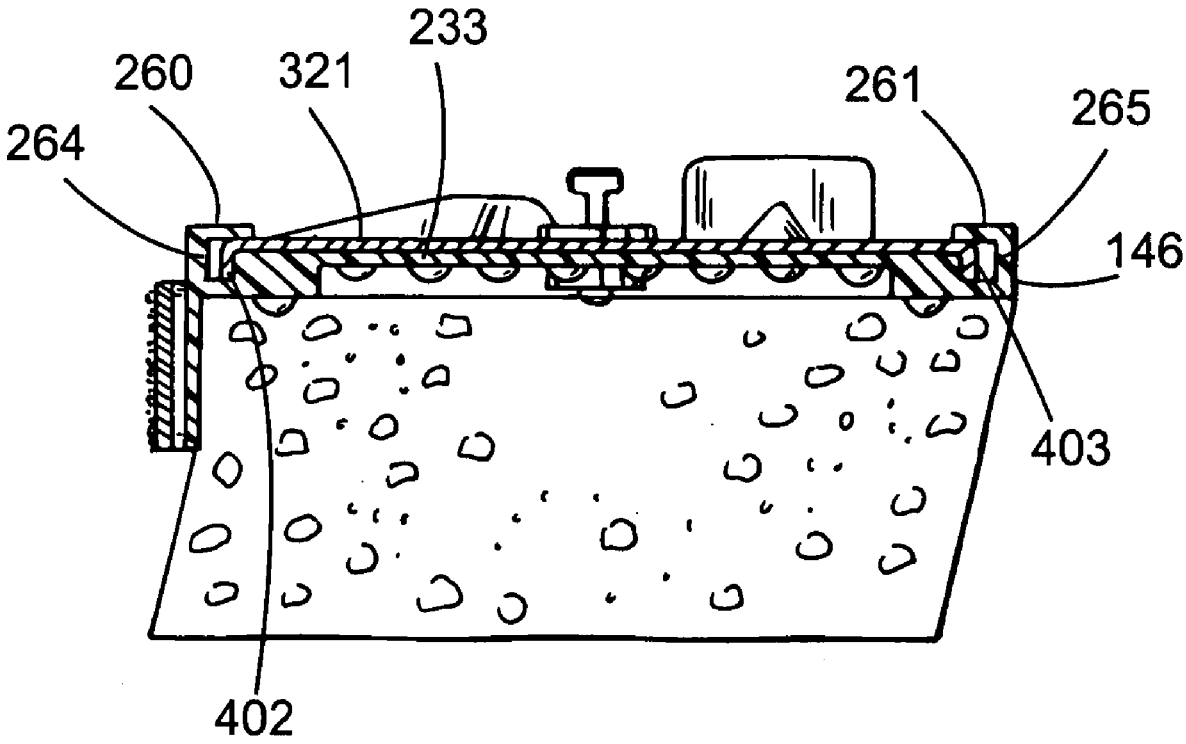
FIG. 24 is a cross-sectional view taken along line 24-24 in FIG. 22.

A mounting bracket 348 can be provided to act as a hinge for pivotally mounting the clasp 324 to the channel body 152. The mounting bracket 348 can include a hinge portion 350 (also shown in FIGS. 20 and 21) for rotatably mounting the clasp 324. The second transverse member 333 of the clasp can extend through the hinge portion 350 of the mounting bracket such that the second transverse member defines a hinge axis 352. The mounting bracket 348 can be received within the groove 298 of the channel body 152. The mounting bracket 348 can be disposed between the tab 300 and the mounting surface of the groove 298 to help retain the mop element support 158 to the channel body 152. The mounting bracket 348 can also be mounted to the channel body 152 via any suitable fastener, such as a rivet 366.

The mop element support 158 is mounted to the channel body 152 in a hinged relationship for allowing relative hinged movement. The mounting bracket 348 can provide for hingedly mounting of the clasp 324 which cooperates together to define the hinge axis 352. The hinge axis 352 is generally perpendicular to the transverse central axial plane of the mop element.

The mop element support 158 can include a biasing mechanism for urging the first and second wings 320, 321 apart toward a longitudinally-aligned position which coincides with the mopping position of the mop element. Referring to FIG. 16, the biasing mechanism can include a pair of springs 358, 359 respectively mounted on the first and second arms 328, 329 of the clasp 324. Each spring 328, 329 can include a pair of legs 362, 363 with one leg 362 engaging the wing rotatably mounted to the arm about which the particular spring is axially disposed and the other leg 363 engaging the other spring. In another embodiment, the biasing mechanism can include a dual coiled spring having first and second legs engaging the first and second wings, respectively. In yet other embodiments, other suitable mechanisms can be used.

Referring to FIGS. 18-21, the first and second wings 320, 321 each include a generally planar body portion 380 having a cam surface 382 and a stop 384 projecting therefrom. The stops 384 inhibit translation of the mop element support 158 along the longitudinal axis 190 relative to the shaft 110. The channel body is provided with rollers 154 and 155, whereby the first roller 154 engages the first wing 320, and the second roller 155 engages the second wing 321. Relative hinged movement of the mop element and the channel body causes the wings 320, 321 to engage against the rollers 154, 155, respectively, and to move in a generally arcuate path relative to the leg portions 290, 291 of the channel body. The first and second rollers 154, 155 are positioned to engage the camming surfaces 382 of the first and second wings 320, 321, respectively, during the wringing sequence.

Figure 19:
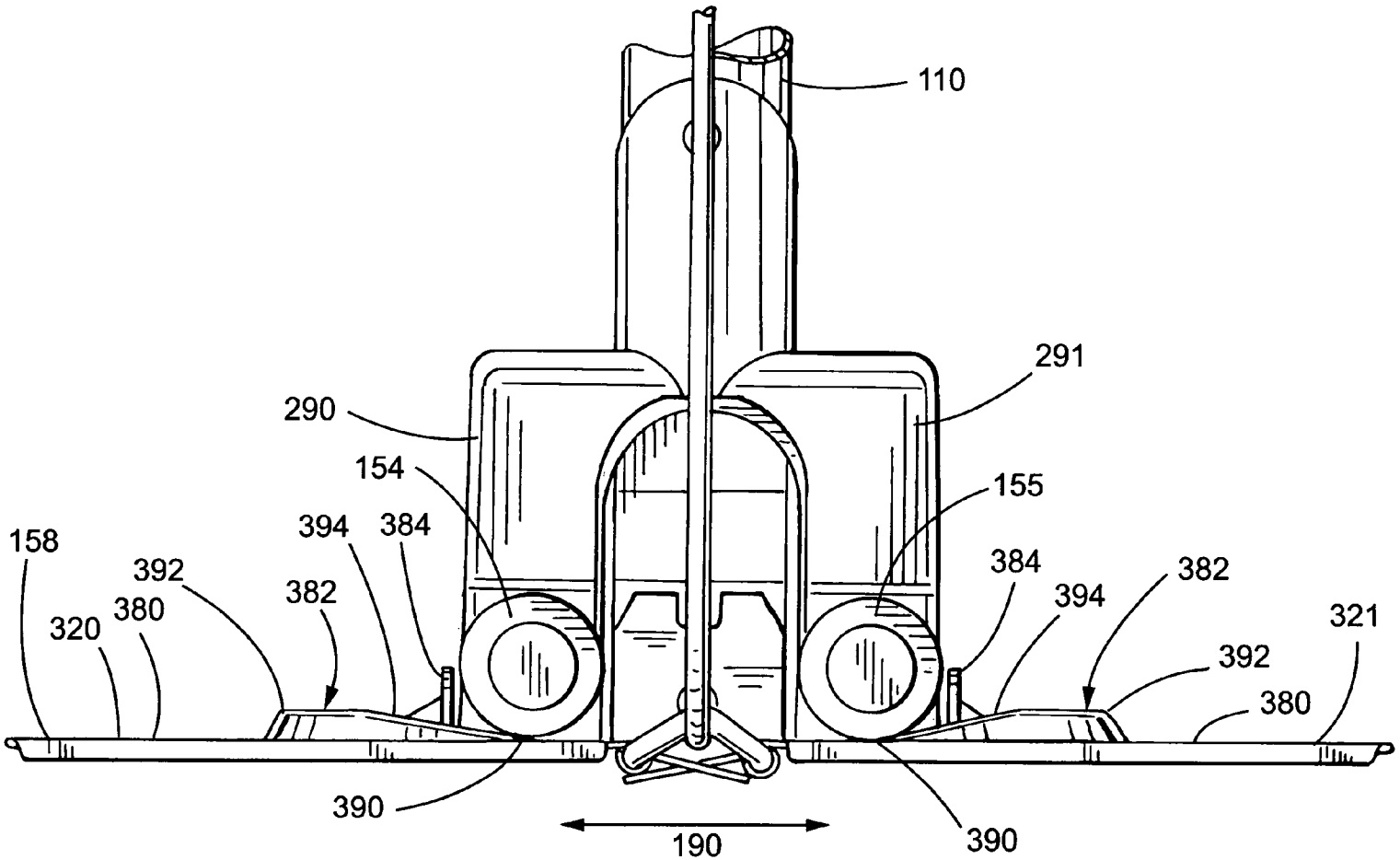
FIG. 19 is a front elevational view of the cleaning end of the mop as shown in FIG. 18.

Referring to FIG. 19, the rollers 154, 155 can cooperate respectively with the cam surface 382 to act as cam followers. Each cam surface 382 includes an inner end 390 and an outer end 392. The cam surfaces 382 each include an inclined portion 394 extending between the inner end 390 and the outer end 392 such that the outer end is relatively further from the body portion 380 of the respective wing than the inner end 390. When the mop element is in the cleaning position, the inner ends 390 of the cam surfaces are disposed in contacting relationship with the first and second rollers 154, 155, respectively, and are adjacent the first and second leg portions 290, 291, respectively, as shown in FIG. 19.

Figure 26:
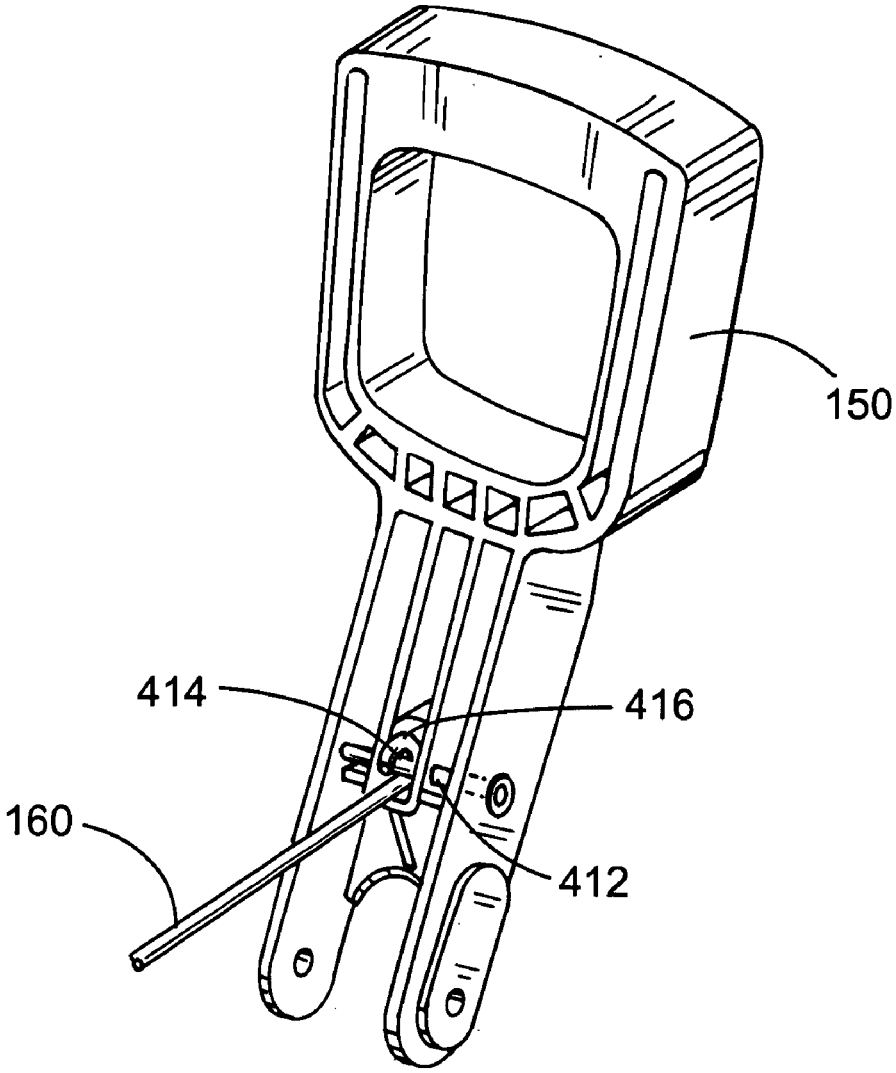
FIG. 26 is an enlarged, fragmentary perspective view of the operator handle of the mop of FIG. 1.

Referring to FIG. 26, the actuator link 160 and the operator handle 150 are pivotally mounted with respect to each other via a pivotal connection 412. The actuator link can include a second eyelet 414 at a proximal end 416 thereof which is pivotally connected to the operator handle 150 via the connecting bar 412 which extends through the second eyelet 414. As shown in FIG. 1, the connecting bar 412 is disposed between the gripping portion 171 of the operator handle and the pivotal mounting 170 of the operator handle 150 on the shaft 110 as a second order lever.

Figure 27:
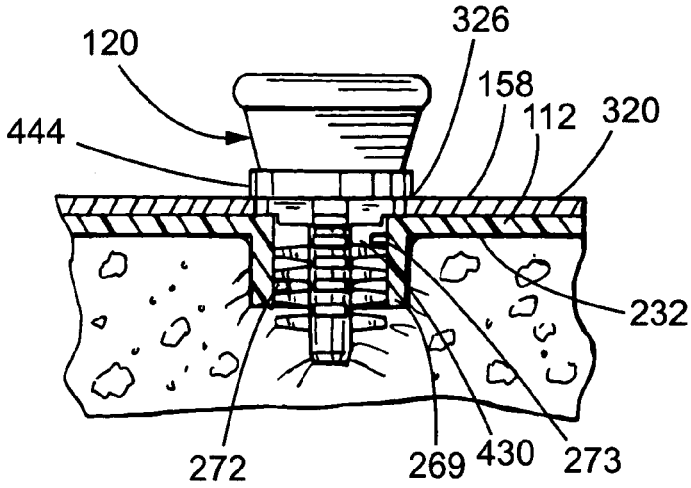
FIG. 27 is a cross sectional view of a fastener engaged with a mop element support and the mop element of the mop of FIG. 1.

In some embodiments, fasteners are used to secure the mop element to the wringing mechanism. The fasteners disclosed in U.S. patent application Ser. No. 09/514,711 may be employed. The mop element can be secured to the wringing mechanism via fasteners such as screws or removable rivets, such as those rivets sold under the trademark Tuflok® by ITW Fastex®. Alternatively, fasteners of the type shown in FIGS. 27-29 may be employed. Referring to FIG. 27, the fastener 120 can be used to secure the mop element 112 to the mop element support 158. The outer mounting apertures 269 of the mop element 112 are positioned for alignment with respective mounting apertures 326 respectively in the first and second wings 320, 321 of the mop element support, shown in FIG. 16. The mounting apertures 326, 269 of the first wing 320 and the first support portion 232 define a first mounting channel 430. Similarly, the mounting apertures of the second wing and the second support portion define a second mounting channel.

Figure 28:
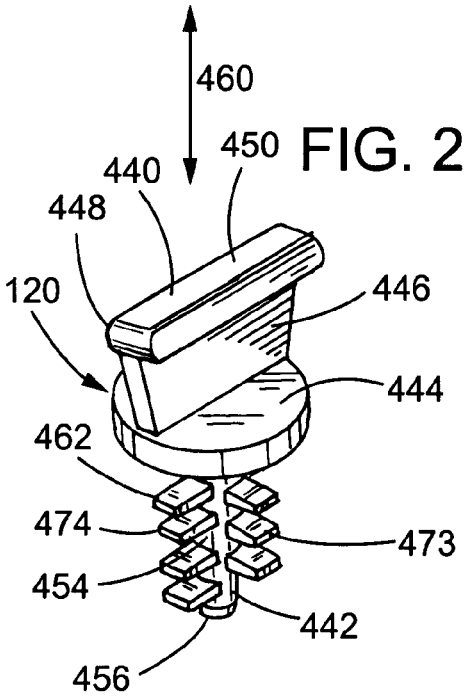
FIG. 28 is a perspective view of the fastener of the mop shown in FIG. 1.
Figure 29:
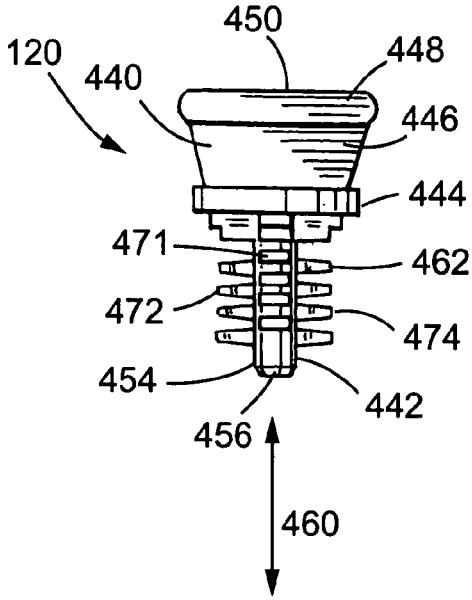
FIG. 29 is a front elevational view of the fastener of FIG. 28.

Referring to FIGS. 28 and 29, each fastener 120 can include an operator gripping portion 440, a retaining portion 442, and an intermediate bearing portion 444 disposed between the gripping portion 440 and the retaining portion 442. The operator gripping portion 440 can include a generally planar body 446 and a flange 448 extending therefrom at a proximal end 450. The retaining portion 442 can include a shaft 454 having a tapered distal end 456 and extending along a longitudinal axis 460. A plurality of barbs 462 can extend from the shaft 454. The barbs 462 can act to frictionally or otherwise engage the mounting channel within which the retaining portion of the fastener is disposed. The barbs 462 can engage the locking lips 272, 273 of the mounting element 146 to facilitate the retentive engagement of the fastener thereto, as shown in FIG. 27.

The plurality of barbs 462 can include a first set 471 of barbs, and corresponding second, third and fourth sets of barbs 472, 473, 474. The first set 471 of barbs can be axially evenly spaced with respect to each other. The second, third, and fourth sets 472, 473, 474 of barbs can be disposed in a similar fashion. Each set of barbs can be in respective circumferential offset relationship with the other sets of barbs. The first set 471 of barbs can oppose the third set 473 of barbs, and the second set 472 of barbs can oppose the fourth set 474 of barbs. Preferably, at least the first and second sets of barbs are axially offset to thereby define at least one internal thread that is engageable with the external threads 272, 273 on the mop element. This configuration permits a simple screw-type fastening of the mop element to the wringing mechanism.

The mop element of the invention is not limited to the configuration shown. For example, the apertures in the mop element may be positioned in any location necessary for alignment with respective apertures in any number of mop element supports. Similarly, it is contemplated that other forms of fasteners could be employed other than the fastener shown in FIG. 27. The mop element and one or more fasteners may be provided in the form of a kit which is adapted for securing the mop element to one or a plurality of predetermined mop element supports, which may be differently sized.

Figure 30:
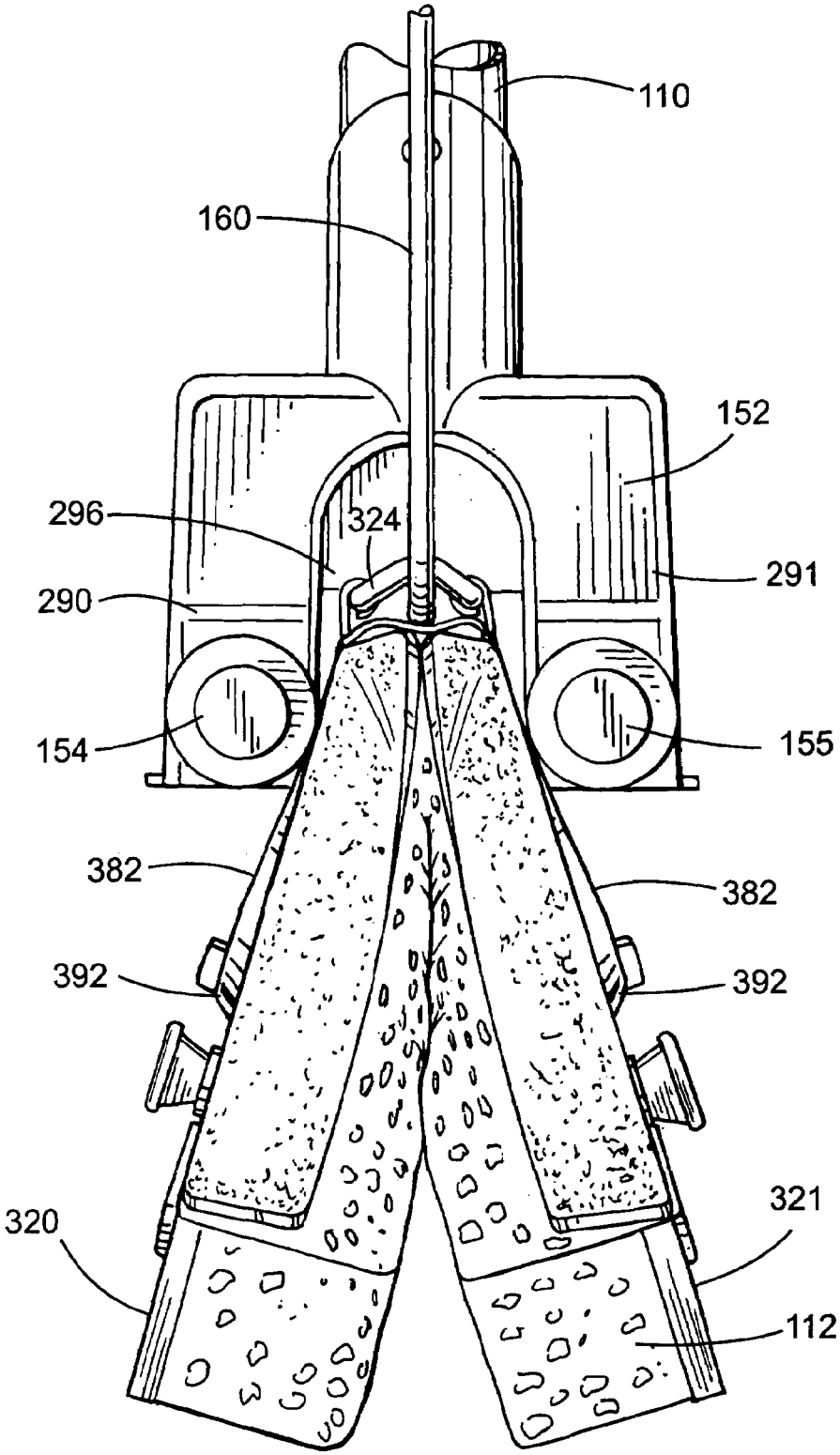
FIG. 30 is an enlarged, fragmentary front elevational view of the cleaning end of the mop shown in FIG. 2, illustrating a mop element in an intermediate position of a wringing sequence with the mop element being drawn into a channel body.
Figure 31:
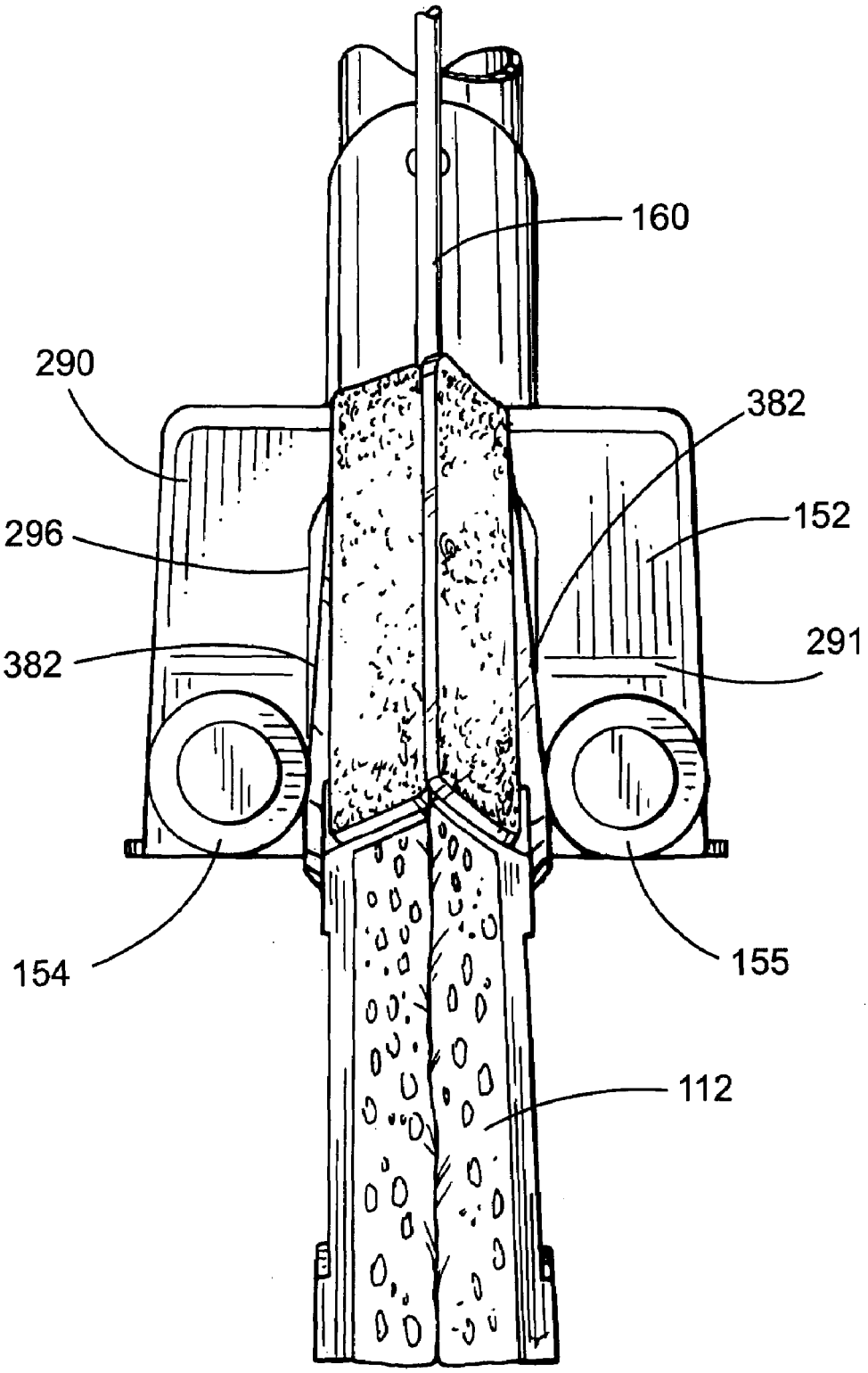
FIG. 31 is a view similar to FIG. 30 with the mop element fully withdrawn into the channel body.
Figure 32:
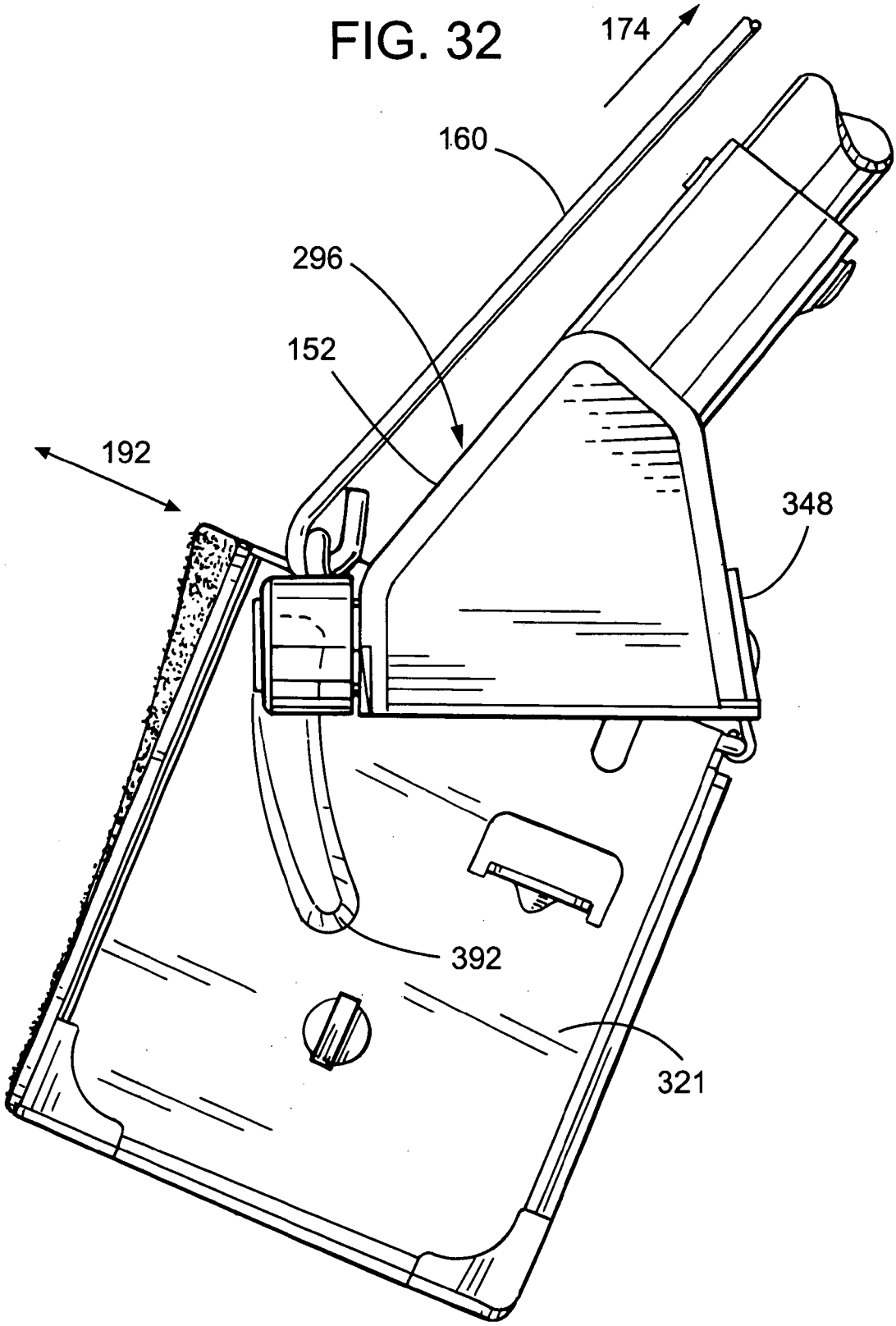
FIG. 32 is an enlarged, side elevational view of the mop shown in the position illustrated in FIG. 30.
Figure 33:
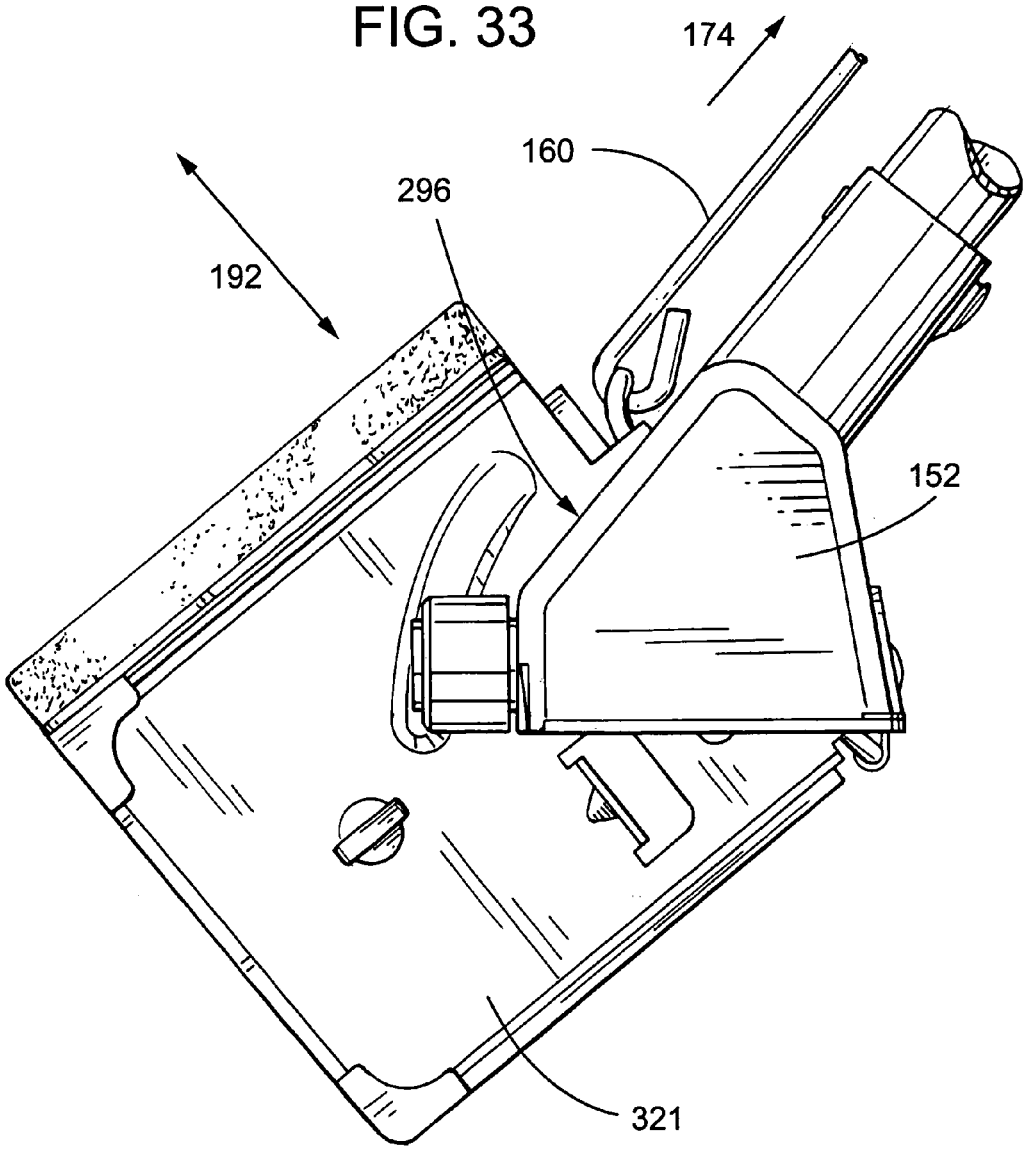
FIG. 33 is an enlarged, side elevational view of the mop shown in the position illustrated in FIG. 31.

Operation of the mop to move the mop element 112 through a wringing sequence is progressively illustrated in FIGS. 30-33. These figures should be deemed exemplary of the wringing of a mop element, but in practice factors such as the thickness of the liquid absorbent member and scrubber strips may change the characteristic of the mop and may thus alter the performance and appearance of the mop during wringing. The mop element 112 is shown in the cleaning position in FIG. 1. Generally, the mop element 112 is wrung by gripping the shaft 110 and the operator handle 150 of the wringer and manually moving the handle 150 with respect to the shaft 110 in the actuating direction 172. When it is desired to expel liquid from the mop element, the operator handle of the wringing mechanism can be moved in the actuating direction whereupon the mop element begins to fold about the central transverse axis 192 and to be drawn into the channel 296 of the channel body 152, as shown in FIGS. 30 and 32. FIGS. 30 and 32 illustrate the mop element 112 when it is partially drawn into the channel 296 of the channel body 152, and FIGS. 31 and 33 illustrate the mop element 112 when it is fully withdrawn into the channel of the channel body and is disposed in the fully compressed wringing position. During the wringing sequence, the wings 320, 321 travel in a complex path which includes a generally arcuate path defined by the mounting bracket 348 and the clasp 324 in cooperation with the rollers 154, 155. The inclined cam surfaces 382 move relative to the rollers 154, 155 of the first and second leg portions such that the rollers respectively travel along the cam surfaces toward the outer ends 392 thereof such that the liquid absorbent member 140 folds about the central axis 192 and, it is believed, becomes increasingly compressed between the leg portions 290, 291 of the channel body.

Figure 34:
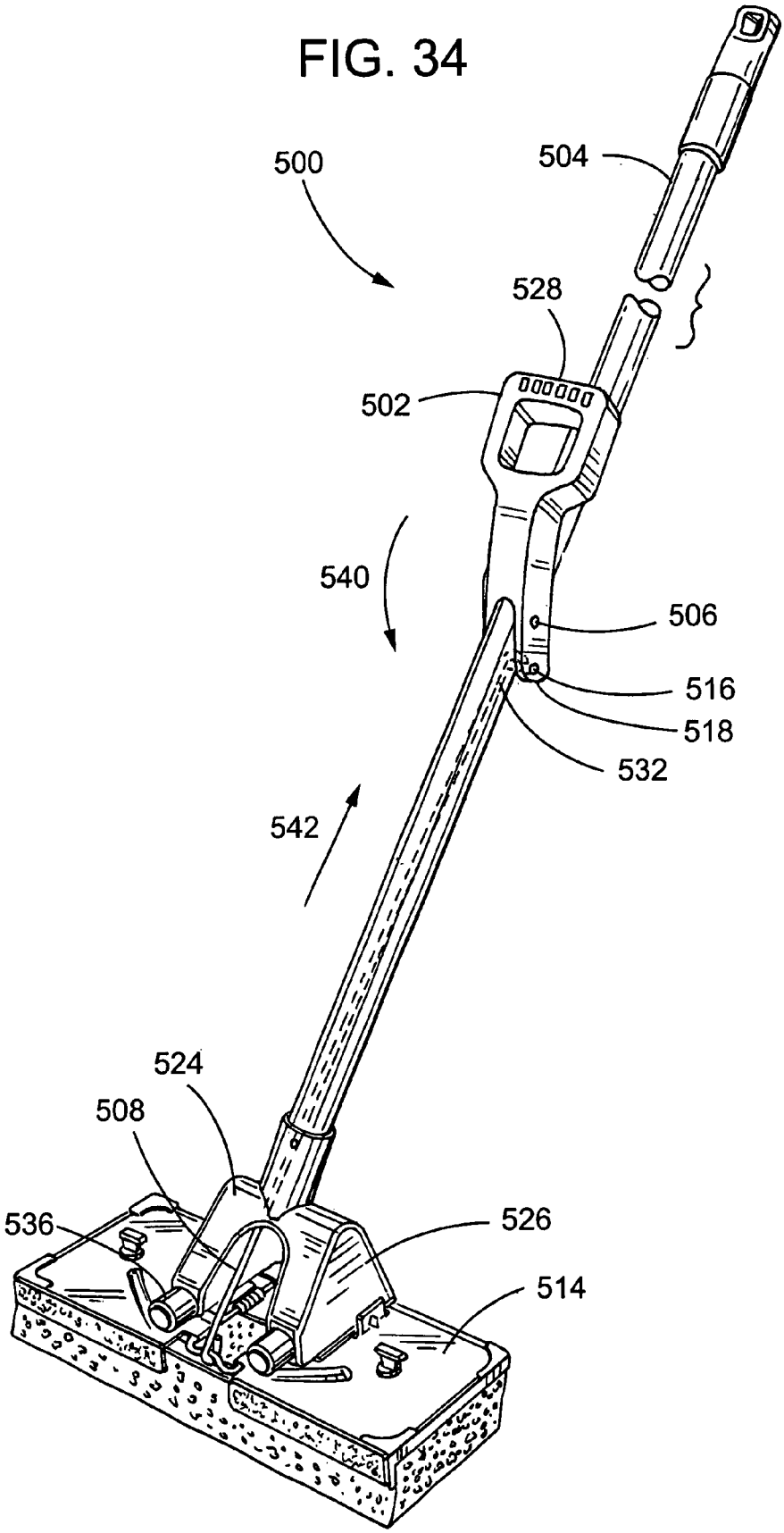
FIG. 34 is a perspective view of an alternative embodiment of the mop of the present invention.

Referring to FIG. 34, another embodiment of a mop 500 according to the present invention is shown. The mop 500 includes an operator handle 502 mounted to the shaft 504 at a central pivot 506. An actuator link 508 is provided which is connected to a mop element support 514 and the operator handle 502. The actuator link 508 is connected to the operator handle at a pivot 516 adjacent a free end 518 of the operator handle 502. The actuator link 508 extends through an aperture in a connecting portion 524 of a channel body 526. The central pivotal mounting 506 of the handle to the shaft is disposed between an operator gripping portion 528 of the operator handle and the pivotal connection 516 of the handle to the actuator link as a first order lever. A slot 532 is provided for allowing the actuator link 508 to extend into the hollow shaft 504. A wringer 536 can be actuated by moving the handle 502 in an actuating direction 540 which is opposite to the actuating direction 172 of the operator handle 150 of FIG. 1. The actuating direction 540 of the handle 502 of FIG. 34 is opposite to a wringing direction 542 in which the actuator link 508 travels during the wringing sequence. The mop 500 of FIG. 34 is similar in other respects to the mop 100 of FIG. 1.

The components of the mop may be made of conventional materials and assembled in a conventional manner. For instance, the wringer, connector, rollers, and hanger cap preferably are made of a plastic material, such as, acetal, ABS (acrylonitrile-butadiene-styrene), or polypropylene, for example. The shaft preferably comprises a hollow tube made of aluminum or thin gauge steel tubing. The connecting link preferably is made of steel, aluminum, or like material. An exemplary material for the mop head is double cell polyether foam. The scrubber strips can be made from any suitable material, such as, a material referred to as blue polyester felt, for example. Each fastener can be made from any suitable material, such as a plastic, for example. The fastener can be one such as that sold by ITW Fastex and referred to as a push-in fastener, for example.

Thus, it is seen that the invention provides a workable cleaning implement. In practice, a cleaning implement may include one or more of the aforementioned features, or all of said features. Other configurations are possible; for instance, the mop head ordinarily may be affixed relative to the shaft and the channel body may be operatively connected to the connecting link.

The scope of the appended claims should not be deemed limited by the preferred embodiment described and illustrated hereinbefore. Nothing stated in prior application Ser. No. 09/514,711 or during the prosecution of said application or any foreign counterpart application should be construed as limiting the scope of the present application. Statements made herein are not intended to affect the scope of prior application Ser. No. 09/514,711.

While particular embodiments to the invention have been described herein, the invention is not limited thereto, but to the contrary should be deemed defined by the full scope of the appended claims. All references and pending applications cited herein are hereby incorporated by reference in their entireties.

What is claimed is:

1. A mop comprising:

an elongate shaft having a cleaning end and an operator end;

a channel body disposed at said cleaning end of said shaft and comprising spaced-apart first and second leg portions defining a channel therebetween;

a mop element, said mop element being disposed in a relatively hinged relationship with respect to said channel body along a hinge axis, said mop element comprising a liquid absorbent member and a mounting element that supports said absorbent member, said mop element having a central axis, said hinge axis being generally perpendicular to said central axis, said central axis dividing said absorbent member into first and second portions, said mounting element including a first support portion and a second support portion, said first support portion connected to said first portion of said absorbent member, and said second support portion connected to said second portion of said absorbent member, and said mounting element including a member connecting said first and second support portions, said member being flexible relative to said first and second support portions;

an actuator link connected to one of said mop element and said channel body, whereby movement of said actuator link relative to the other of said mop element and said channel body in a wringing direction causes relative hinged movement of said mop element and said channel body about said hinge axis, thereby drawing said mop element into said channel and causing said first and second portions of said mop element to fold toward each other about said central axis and to become compressed between said leg portions of said channel body; and a mop element support including a first wing and a second wing;

wherein said first support portion of said mounting element is mounted to said first wing of said mop element support, and said second support portion of said mounting element is mounted to said second wing of said mop element support, and wherein at least one of said first and second wings includes an inclined cam surface, said inclined cam surface having an inner end and an outer end, said outer end closer to said operator end of said shaft than said inner end, said inner end being relatively proximal said central axis of said absorbent member and said surface increasing in inclination from said inner end to said outer end, said cam surface engaging a portion of said channel body as said wings are drawn into said channel body.

2. The mop according to claim 1, further comprising:

an operator handle, said operator handle being movably mounted to said shaft, said actuator link connected to said operator handle, said operator handle including a gripping portion, whereby movement of said gripping portion in an actuating direction relative to said shaft causes said actuator link to move in said wringing direction.

3. The mop of claim 2 wherein said operator handle includes a pivotal mounting on said shaft and a pivotal connection to a portion of said actuator link proximal said operator end.

4. The mop according to claim 1, wherein said mop element support includes biasing means urging said wings apart.

5. The mop according to claim 4, further comprising a stop restricting the biasing of said wings to a generally aligned position.

6. The mop according to claim 1, wherein said mop element support includes a clasp disposed between said first wing and said second wing, said wings being hingedly connected to said clasp.

7. The mop according to claim 6, wherein said clasp has a first arm and a second arm, said first wing being hingedly connected to said clasp at said first arm and said second wing being hingedly connected to said clasp at second arm.

8. The mop according to claim 7, wherein said clasp has a third arm hingedly connected to said channel body at said hinge axis.

9. The mop according to claim 6, said clasp including a bent portion defining a notch, said actuator link including a distal end, said distal end of said actuator link having a hook disposed in said notch.

10. The mop according to claim 1, wherein said first leg portion includes a first roller rotatably mounted thereon and engaging said first wing, and said second leg portion includes a second roller rotatably mounted thereon and engaging said second wing, whereby said relative hinged movement of said mop element and said channel body causes said wings to engage said rollers as said wings are drawn into said channel body.

11. The mop according to claim 1, wherein said channel body has a body portion which connects said first and second leg portions.

12. The mop according to claim 11, wherein said actuating link extends through said body portion.

13. The mop according to claim 11, wherein said actuating link extends around said body portion.

14. The mop according to claim 1, wherein said mop element includes a second member connecting said first and second support portions, said second member being flexible relative to said first and second support portions.

15. An elongate mop element comprising:

a compressible, elongate liquid absorbent member, said absorbent member having a first portion and a second portion;

a mounting element, said liquid absorbent member connected to said mounting element, said mounting element including a first support portion and a second support portion, said first support portion connected to said first portion of said absorbent member, and said second support portion connected to said second portion of said absorbent member, and said mounting element including a member connecting said first and second support portions, said member being relatively more flexible than said first support portion and said second support; and a scrubber member, said scrubber member comprising a material that is abrasive relative to said liquid absorbent member, said scrubber member being attached to said mounting element.

16. The mop element according to 15, wherein said first support portion includes a flange which defines a flange portion, said scrubber member connected to said flange portion.

17. The mop element according to claim 16, said flange being resilient and allowing flexure between said flange portion and said support portion.

18. The mop element according to claim 16, wherein said second support portion includes a flange which defines a flange portion, said second flange portion having a second scrubber member connected thereto.

19. A mop comprising:

an elongate shaft having a cleaning end and an operator end;

a mop element disposed at said cleaning end of said shaft, said mop element comprising a compressible, elongate liquid absorbent member having a central axis, said central axis dividing said absorbent member into first and second portions; and a wringing mechanism connected to said shaft and said mop element, said wringing mechanism operable to compress said liquid absorbent member about said central axis to expel liquid therefrom;

wherein said mop element comprises a mounting element, said mounting element supporting said liquid absorbent member, said mounting element mounted to said wringing mechanism, said mounting element including a first support portion and a second support portion, said first support portion connected to said first portion of said absorbent member, and said second support portion connected to said second portion of said absorbent member, and said mounting element including a flexible member connecting said first and second support portions; and wherein said mop element comprises a scrubber member, said scrubber member comprising a material that is abrasive relative to said liquid absorbent member, said scrubber member attached to said mounting element.

20. The mop according to claim 19, wherein said first support portion includes a flange which defines a flange portion, said scrubber member connected to said flange portion.

21. The mop according to claim 20, said flange being resilient and allowing flexure between said flange portion and said support portion.

22. The mop element according to claim 20, wherein said second support portion includes a flange which defines a flange portion, said second flange portion having a second scrubber member connected thereto.

23. A mop comprising:

an elongate shaft having a cleaning end and an operator end;

a mop element comprising a compressible, elongate liquid absorbent member having a central axis and a scrubber member, said scrubber member comprising a material that is abrasive relative to said liquid absorbent member; and an actuator link, whereby movement of said actuator link in a wringing direction causes folding of said mop element about said central axis and compression of said mop element;

wherein said central axis divides said absorbent member into first and second portions, and said mop element comprises a mounting element, said liquid absorbent member and said scrubber member attached to said mounting element, said mounting element including a first support portion and a second support portion, said first support portion connected to said first portion of said absorbent member, and said second support portion connected to said second portion of said absorbent member.

24. The mop according to 23, wherein said mop element is disposed in a relatively hinged relationship with respect to a channel body along a hinge axis, said hinge axis being generally perpendicular to said central axis, wherein movement of said actuating link in said wringing direction causes relative hinged movement of said mop element and said channel body about said hinge axis.

25. The mop according to 23, wherein said mounting element includes a flexible member connecting said first and second support portions.

26. The mop according to claim 25, wherein said mounting element includes a second flexible member connecting said first and second support portion.

27. The mop according to claim 26, wherein said first support portion includes a flange which defines a flange portion, said scrubber member connected to said flange portion.

28. The mop according to claim 27, said flange being resilient and allowing flexure between said flange portion and said support portion.

29. The mop according to claim 27, wherein said second support portion includes a flange which defines a flange portion, said second flange portion having a second scrubber member connected thereto.

30. A mop comprising:

an elongate shaft having a cleaning end and an operator end;

a mop element disposed at said cleaning end of said shaft, said mop element having a central axis and a compressible, elongate liquid absorbent member, said central axis dividing said absorbent member into first and second portions;

a wringing mechanism connected to said shaft and said mop element, said wringing mechanism operable to compress said liquid absorbent member about said central axis to expel liquid therefrom, said wringing mechanism further comprising a mop element support including a first wing connected to said first portion of said absorbent member and a second wing connected to said second portion of said absorbent member; and a fastener for securing said mop element to said wringing mechanism, said fastener comprising an operator gripping portion, a shaft extending through an aperture in said first wing of said mop element support, and a plurality of barbs, said fastener retentively engaging said first portion of said absorbent member.

31. The mop according to claim 30, wherein said shaft of said fastener extends along a longitudinal axis, and said plurality of barbs comprises a first set of barbs and a second set of barbs, said first set of barbs being disposed in an axially spaced relationship with each other and aligned with each other along said longitudinal axis, said second set of barbs being disposed in a longitudinal spaced relationship with each other and aligned with each other along said longitudinal axis, said first and second sets of barbs being respectively circumferentially offset.

32. The mop according to claim 31, wherein said plurality of barbs comprises a third set of barbs and a fourth set of barbs, said third set of barbs being disposed in an axially spaced relationship with each other and aligned with each other along said longitudinal axis, said fourth set of barbs being disposed in an axially spaced relationship with each other and aligned with each other along said longitudinal axis, said first, second, third, and fourth set of barbs each being respectively circumferentially offset.

33. The mop according to claim 32, wherein said first set of barbs opposes said third set of barbs, and said second set of barbs opposes said fourth set of barbs.

34. The mop according to claim 31, said first and second sets of barbs each being evenly spaced and axially offset from one another thereby defining at least one internal thread, said first wing including an external thread permitting coupling with said internal thread.

35. The mop according to claim 34, said fastener including third and fourth sets of barbs.

36. A mop comprising:

an elongate shaft having a cleaning end and an operator end;

a channel body disposed at said cleaning end of said shaft and comprising spaced-apart first and second leg portions defining a channel therebetween;

a mop element, said mop element being disposed in a relatively hinged relationship with respect to said channel body along a hinge axis, said mop element comprising a liquid absorbent member and a mounting element that supports said absorbent member, said mop element having a central axis, said hinge axis being generally perpendicular to said central axis, said central axis dividing said absorbent member into first and second portions, said mounting element including a first support portion and a second support portion, said first support portion connected to said first portion of said absorbent member, and said second support portion connected to said second portion of said absorbent member, and said mounting element including a member connecting said first and second support portions, said member being flexible relative to said first and second support portions;

an actuator link connected to one of said mop element and said channel body, whereby movement of said actuator link relative to the other of said mop element and said channel body in a wringing direction causes relative hinged movement of said mop element and said channel body about said hinge axis, thereby drawing said mop element into said channel and causing said first and second portions of said mop element to fold toward each other about said central axis and to become compressed between said leg portions of said channel body;

a mop element support including a first wing and a second wing;

wherein said first support portion of said mounting element is mounted to said first wing of said mop element support, and said second support portion of said mounting element is mounted to said second wing of said mop element support, wherein said first and second wings each includes a pair of outer corners, and wherein said first and second support portions of said mounting element each includes a pair of outer corner sleeves, said corner sleeves of said first support portion respectively receiving at least a portion of said outer corners of said first wing, and said corner sleeves of said second support portion respectively receiving at least a portion of said outer corners of said second wing.

37. A mop comprising:

an elongate shaft having a cleaning end and an operator end;

a channel body disposed at said cleaning end of said shaft and comprising spaced-apart first and second leg portions defining a channel therebetween;

a mop element, said mop element being disposed in a relatively hinged relationship with respect to said channel body along a hinge axis, said mop element comprising a liquid absorbent member and a mounting element that supports said absorbent member, said mop element having a central axis, said hinge axis being generally perpendicular to said central axis, said central axis dividing said absorbent member into first and second portions, said mounting element including a first support portion and a second support portion, said first support portion connected to said first portion of said absorbent member, and said second support portion connected to said second portion of said absorbent member, and said mounting element including a member connecting said first and second support portions, said member being flexible relative to said first and second support portions, wherein said mop element comprises a scrubber member, said scrubber member comprising a material that is abrasive relative to said liquid absorbent member, said scrubber member attached to said mounting element; and an actuator link connected to one of said mop element and said channel body, whereby movement of said actuator link relative to the other of said mop element and said channel body in a wringing direction causes relative hinged movement of said mop element and said channel body about said hinge axis, thereby drawing said mop element into said channel and causing said first and second portions of said mop element to fold toward each other about said central axis and to become compressed between said leg portions of said channel body.

38. The mop according to claim 37, wherein said first support portion includes a flange which defines a flange portion, said scrubber member connected to said flange portion.

39. The mop according to claim 38, said flange being resilient and allowing flexure between said flange portion and said support portion.

40. The mop according to claim 38 wherein said second support portion includes a flange which defines a flange portion, said second flange portion having a second scrubber member connected thereto.

* * * * *